United States Patent [19]

Kovacs et al.

[11] Patent Number: 4,815,253

[45] Date of Patent: Mar. 28, 1989

[54] FORMING, FILLING AND SEALING BAGS AND DEPOSITING THEM IN CARTONS

[75] Inventors: Lloyd Kovacs; Matthew R. Lind, both of Sheboygan, Wis.

[73] Assignee: Hayssen Manufacturing Company, Sheboygan, Wis.

[21] Appl. No.: 65,014

[22] Filed: Jun. 19, 1987

[51] Int. Cl.[4] ..... B65B 9/10; B65B 63/02

[52] U.S. Cl. ..... 53/436; 53/173; 53/451; 53/564; 493/319

[58] Field of Search ..... 53/438, 529, 526, 527, 53/436, 451, 173, 564, 458, 175, 551, 552; 493/318, 319, 182

[56] References Cited

U.S. PATENT DOCUMENTS

| | | | |
|---|---|---|---|
| 2,327,267 | 8/1943 | Howard | 53/173 |
| 3,314,210 | 4/1967 | Jarund | 53/27 |
| 3,334,466 | 8/1967 | Scholle | 53/451 |
| 3,545,983 | 12/1970 | Woods | 53/451 X |
| 3,592,003 | 7/1971 | Stichhan | 53/564 X |
| 3,774,509 | 11/1973 | Heinzer | 93/18 |
| 3,983,682 | 10/1976 | Scully | 53/126 |
| 4,084,390 | 4/1978 | Schmachtel et al. | 53/112 |
| 4,215,520 | 8/1980 | Heinzer et al. | 53/173 |
| 4,288,965 | 9/1981 | James | 53/451 |
| 4,546,596 | 10/1985 | Cherney | 53/451 |
| 4,571,926 | 2/1986 | Scully | 53/525 |
| 4,589,506 | 5/1986 | Hirano | 177/25 |
| 4,642,975 | 2/1987 | Langen et al. | 53/564 |

FOREIGN PATENT DOCUMENTS 2061219 9/1980 United Kingdom .

*Primary Examiner*—James F. Coan

*Attorney, Agent, or Firm*—Senniger, Powers, Leavitt and Roedel

[57] ABSTRACT

A method of and apparatus for forming, filling and sealing bags and depositing the filled bags in cartons, wherein the bags are formed, filled and sealed by a vertical form-fill-seal machine and each bag is compressed to shape it to fit in a carton.

49 Claims, 22 Drawing Sheets

FORMING, FILLING AND SEALING BAGS AND DEPOSITING THEM IN CARTONS

BACKGROUND OF THE INVENTION

This invention relates to a method of and apparatus for forming, filling and sealing bags and depositing the filled and sealed bags in cartons, and more particularly to such a method and apparatus for the packaging of a particulate product such as dry breakfast cereal.

The method and apparatus of this invention are in the same general field as the method and apparatus disclosed in U.S. Pat. Nos. 3,983,682 and 4,571,926, for example, and involve utilization of a vertical form/fill-/seal packaging machine such as disclosed in U.S. Pat. No. 4,288,965 of Robert C. James issued Sept. 15, 1981 to the assignee of this application, and of a carton conveyor such as disclosed in U.S. Pat. No. 4,642,975 of Marinus J. M. Langen et al., issued Feb. 17, 1987 and assigned by mesne assignments to the assignee of this application, and a combination weighing scale such as disclosed in U.S. Pat. No. 4,589,506 of Takashi Hirano, issued May 2, 1986 to Yamato Scale Co. Ltd. of Akashi, Japan, the disclosures of these U.S. patents being incorporated herein by reference.

SUMMARY OF THE INVENTION

Among the several objects of this invention may be noted the provision of an improved and relatively simplified and reliable method of and apparatus for forming, filling and sealing bags and depositing them in cartons utilizing a single vertical form, fill and seal packaging machine, which may be a high speed packaging machine, and a cartoner in association with the packaging machine, the apparatus being of a type that may be referred to as a stand-alone apparatus; the provision of such apparatus which takes up relatively low floor space in a plant, is of relatively low height, and is economical to provide and use, considering its output; the provision of such apparatus which is adapted for ready change-over for forming different sizes of bags and packaging them in corresponding different sizes of cartons; the provision of improved means for setting up cartons for deposit of the filled bags therein with this set-up means being useful in conjunction with the filling of the cartons with unbagged product; and the provision of improved means for opening certain flaps of the cartons as they are conveyed to a position for receiving the bags or unbagged product.

In one aspect, the invention is directed to a method of and apparatus for forming, filling and sealing bags and depositing the filled and sealed bags in cartons, one bag per carton, each carton being one having front and back (major) walls and side (minor) walls and closure flaps at the upper and lower ends of said walls and being of the type which may be supplied in a folded-flat collapsed condition and set up to an expanded open condition wherein it is substantially rectangular in transverse cross section. In general, the method of the invention comprises forming flexible sheet packaging material into tubing, intermittently feeding the tubing downwardly one bag length, the tubing dwelling between successive feed cycles, and sealing the tubing transversely during the dwell following each downward feed of the tubing to form a top seal for a bag to complete the bag and a bottom seal for the next bag to be formed. Product is delivered into the lower end of the sealed tubing for each bag being formed prior to the formation of the top seal for the bag. An opened carton is positioned at a carton loading station below and generally in line with the bag being formed for deposit of the bag in the carton. The bag length at the lower end of the tubing, containing product, has a front, back and sides. It is constrained at the front, back and at the sides to a shape such as to fit in the said opened carton. The tubing is severed between the top and bottom seals to separate the filled, sealed and constrained bag from the tubing; and the constraint on the said filled, sealed and separated bag is removed at the front and back for descent of the bag into the carton.

In general, the apparatus of this invention comprises means for forming flexible sheet packaging material into tubing, means for intermittently feeding the tubing downwardly one bag length, the tubing dwelling between successive feed cycles, and means for sealing the tubing transversely during the dwell following each downward feed of the tubing to form a top seal for a bag to complete the bag and a bottom seal for the next bag to be formed. Means is provided for delivering a charge of product into the lower end of the tubing for each bag being formed prior to the formation of the top seal for the bag. Means is provided for positioning an opened carton at a carton loading station below and generally in line with the bag being formed for deposit of the bag in the carton. The bag length at the lower end of the tubing, containing product, has a a front, back and sides. Means is provided for constraining said bag length at the front, back and at the sides to a shape such as to fit in the said opened carton, for severing the tubing between said top and bottom seals to separate the filled sealed and constrained bag from the tubing, and for removing the constraint on the said filled, sealed and separated bag at the front and back for descent thereof into the carton.

In another aspect of the invention, cartons are conveyed by an endless conveyor to carton loading position or station below and generally in line with the bag being formed, the conveyor having a series of carton holders spaced at equal intervals therealong. Means is provided for delivering a carton to each holder at a delivery station, comprising means for holding a supply stack of folded flat cartons on the outside of the conveyor with the stack generally horizontal, and extending toward the conveyor with the end of the stack toward the conveyor adjacent the conveyor, means for opening or setting up the carton at that end of the stack, and means for drawing the opened carton into a holder. The set-up means is useful in conjunction with apparatus including the conveyor for filling the cartons with unbagged product.

In a further aspect of the invention, means is provided for swinging the top minor closure flaps of each carton outwardly as the carton is conveyed toward the carton loading position. This flap-manipulating means is also useful in conjunction with apparatus including the conveyor for filling the cartons with unbagged product.

Other objects and features will be in part apparent and in part pointed out hereinafter.

BRIEF DESCRIPTION OF THE DRAWINGS

Corresponding reference characters indicate corresponding parts throughout the several views of the drawings.

DETAILED DESCRIPTION

Figure 8:
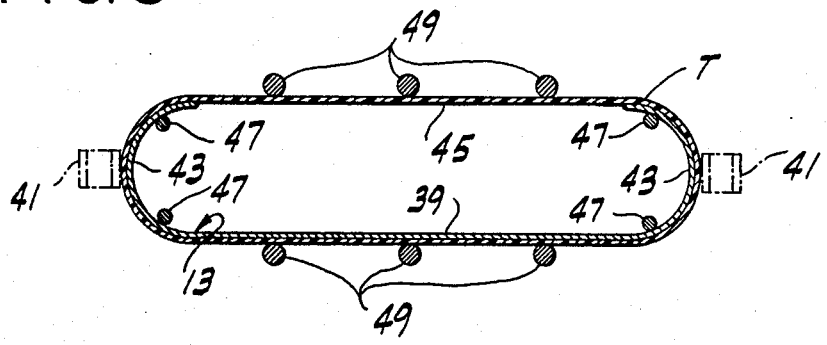
FIG. 8 is an enlarged horizontal section generally on line 8—8 of FIG. 2, indicating certain pull belts of the VFFS machine.

Referring to the drawings, the reference numeral 1 designates a vertical form-fill-seal packaging machine, which may be referred as a "VFFS" machine, for forming packages, more particularly bags, from a web of flexible packaging material, e.g. plastic film, each bag having a measured quantity (a "charge") of product sealed therein. The packaging machine 1 is preferably a machine such as that sold under the trademark ULTIMA by Hayssen Manufacturing Company of Sheboygan, Wis., assignee of this invention and application, and covered by the aforesaid James U.S. Pat. No. 4,288,965. This machine is a high-speed machine operable in cycles in each of which a bag length increment of the web indicated at W in said James patent is pulled from a supply roll indicated at R in said patent by measuring and feeding rolls indicated at 19 and 21 in said James patent and fed over a forming shoulder 3 for forming it into bag tubing T, the tubing being directed downwardly around a vertically extending tubular mandrel 13. The longitudinal margins of the web are brought together by the forming shoulder and sealed by sealing means at 15 which extend vertically at the front of the mandrel to form a longitudinal seam for the tubing. The bag length increment of the web fed forward by the measuring and feeding rolls is taken up and pulled over the forming shoulder by pull belts indicated at 41 in said James patent, and at 41 in FIG. 8, which function to pull the tubing T downward and feed it off the lower end of the mandrel. Product to be packaged (such as a dry breakfast cereal food product) is provided in measured quantity in the tubing. Sealing means comprising a pair of sealing bars 17 is operable below the lower end of the mandrel for transversely sealing the tubing to form the bags each with a measured quantity of product therein.

Figure 6:
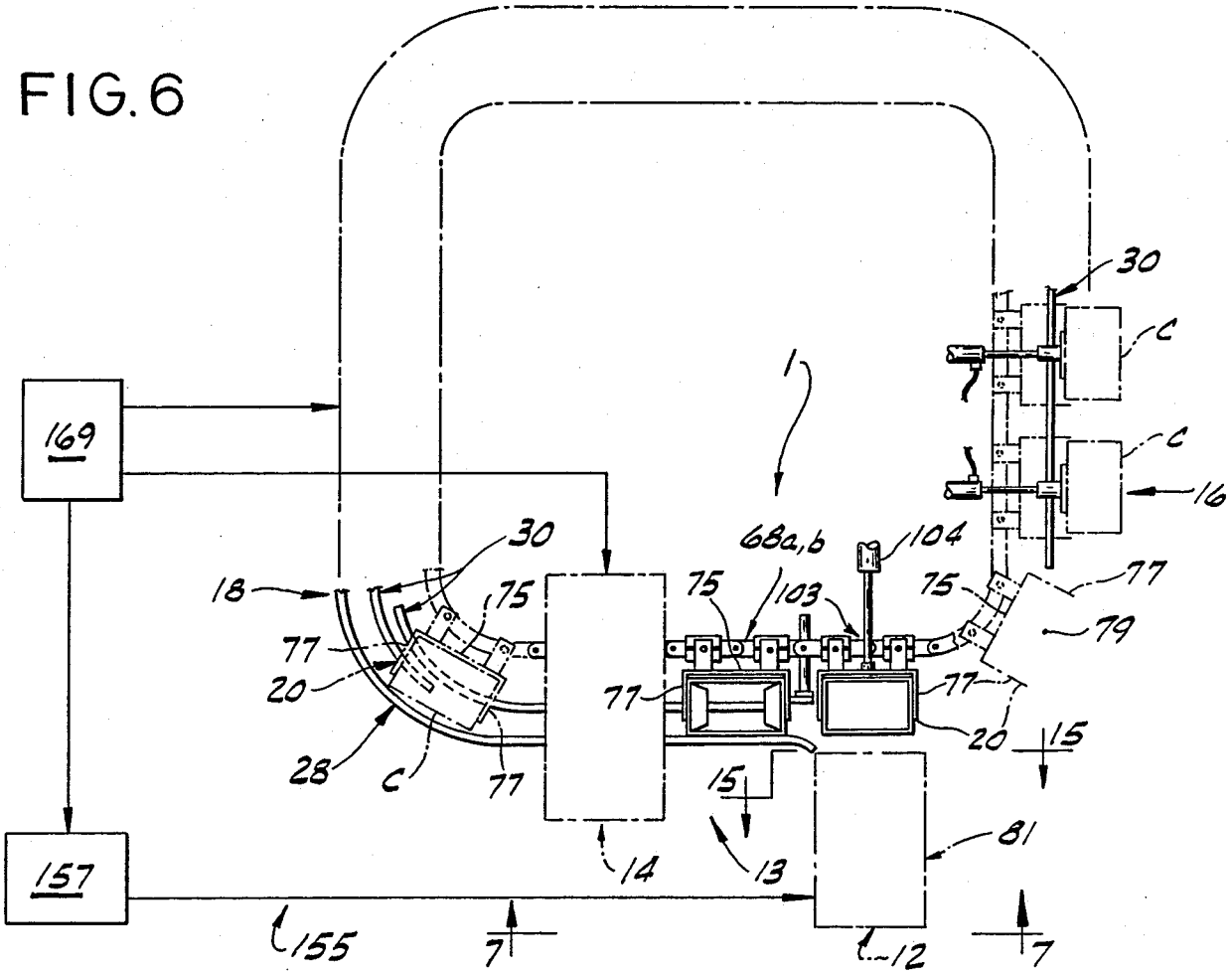
FIG. 6 is a semi-diagrammatic view in plan showing the carton conveyor referred to above and the location relative to the carton conveyor of means for delivering cartons to the conveyor at a carton delivery station and the location of the VFFS machine at a carton loading station.

Reference may be made to the aforesaid James U.S. Pat. No. 4,288,965, and to the Cherney U.S. Pat. No. 4,546,596 issued Oct. 15, 1985 (also assigned to the assignee of this invention and application), this latter patent also being incorporated herein by reference, for details of the construction and operation of the VFFS machine 1. For purposes of description of the present invention, it will suffice to say that in each cycle of operation of the packaging machine, with the sealing bars 17 (and 15) open, a bag length increment of the tubing T, sealed as indicated by the reference character S1 at its lower end as a result of the previous cycle, is fed down off the lower end of the mandrel. The measured quantity (the "charge") of product for the bag which is being formed in the cycle is delivered downwardly through the mandrel into the lower end of the tubing. The sealing bars are closed on the tubing above the product therein to form a top seal S2 for the bag being completed and a bottom seal S1 for the next bag to be formed. Cutting means such as the knife 71 shown in the aforesaid Cherney U.S. Pat. No. 4,546,596 incorporated in the sealing means operates to cut the tubing transversely between the bag top seal and the bag bottom seal made by the sealing bars. The latter are opened as the cycle concludes for release of the completed bag and for the start of the next cycle. Each bag, as completed by the closure of the sealing bars 17 to form the top seal therefor and the cutting of the tubing T between that seal and the bottom seal of the next bag, and upon opening of the sealing bars to release it, is deposited in a box or carton C which has been brought into position at a station designated 14 (which may be referred to as the carton loading station) below and generally in line with the bag being formed by means comprising a carton conveyor designated in its entirety by the reference numeral 18 (FIG. 6).

Figure 26:
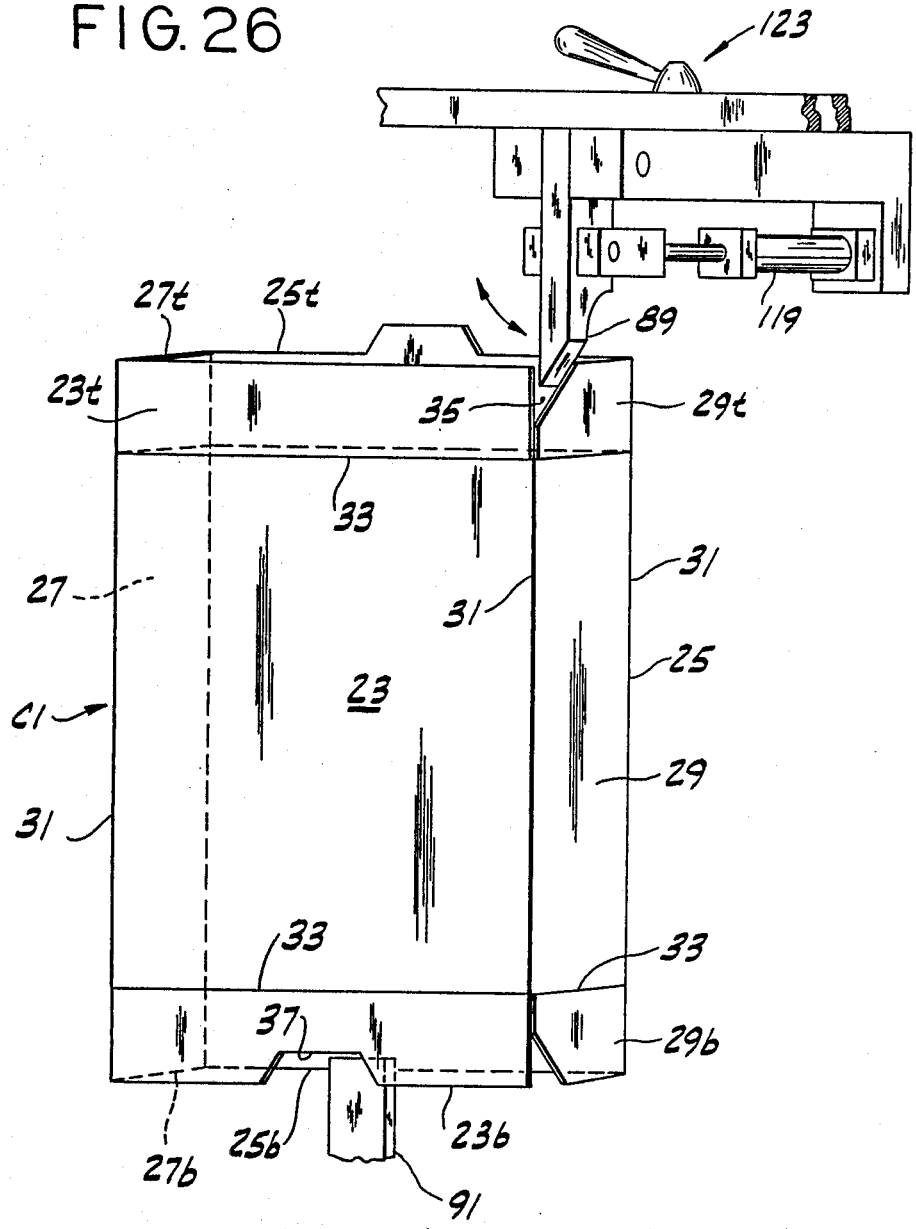
FIG. 26 is a perspective showing a carton being opened and how it is held while being opened.

Generally, the cartons used for packaging in accordance with this invention are conventional knock-down paperboard cartons such as shown best in FIG. 26, each adapted to be supplied in a folded-flat collapsed configuration in which it is illustrated in FIGS. 15–18 and adapted to be set up or expanded to the open configuration in which is illustrated in FIGS. 1, 3, 5, 24 and 25 wherein it is substantially rectangular in transverse (horizontal) cross section. Thus, the carton has opposed walls 23 and 25 which may be referred to as the "major" walls, one constituting the front and the other the back wall of the carton, and opposed "minor" or side walls 27 and 29. The "major" walls have "major" top closure flaps **23*t* and 25*t* at their upper edges and "major" bottom closure flaps 23*b* and 25*b* at their bottom edges. The "minor" walls have "minor" top closure flaps 27*t* and 29*t* at their upper edges and "minor" bottom closure flaps 27*b* and 29*b* at their lower edges. The walls 23, 25, 27 and 29 are integrally hinged at their junctures as indicated at 31 and the closure flaps are integrally hinged at their juncture to the respective walls as indicated at 33. The top minor closure flap 29*t* is cut so that there is a space 35 between it and the adjacent edge of the top major flap 23*t*, and the bottom major flap 23*b* has a notch 37, this space and this notch being utilized in conjunction with the delivery of cartons to the conveyor 18** as will appear.

Figure 9:
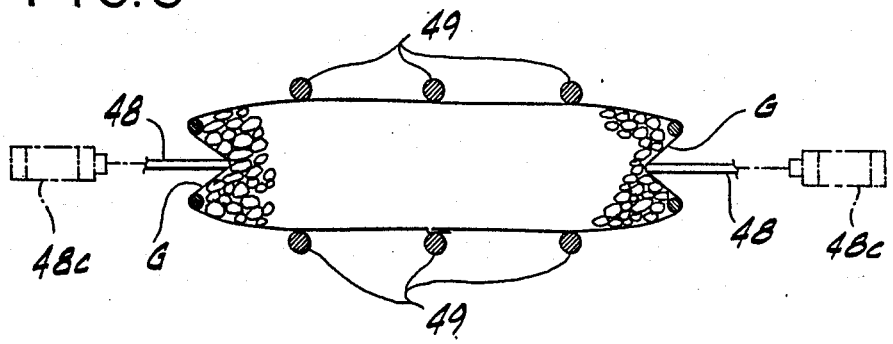
FIG. 9 is an enlarged horizontal section generally on line 9—9 of FIG. 2 and generally on the same scale as FIG. 8 showing how the bag tubing may be formed with gussets or intucks for corners of the bags being formed.
Figure 10:
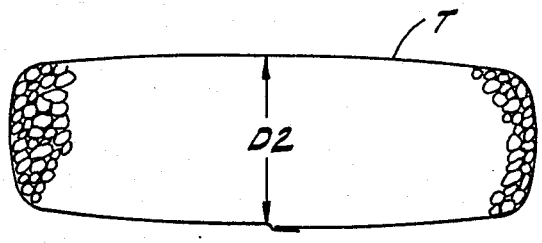
FIG. 10 is a horizontal section generally on line 10—10 of FIG. 2 and generally on the same scale as FIGS. 8 and 9 showing the lower end of the bag tubing formed by the VFFS machine with product therein in an enlarged phase.
Figure 11:
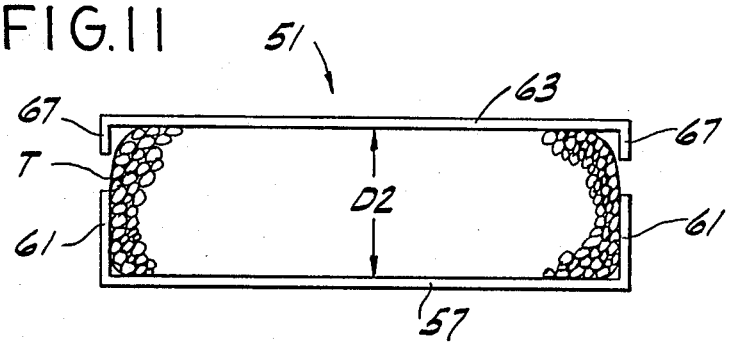
FIG. 11 is a horizontal section generally on line 11—11 of FIG. 2 and drawn on the same scale as FIGS. 8-10 showing the lower end of the bag tubing entered in the bag shaping means, the latter being open.
Figure 12:
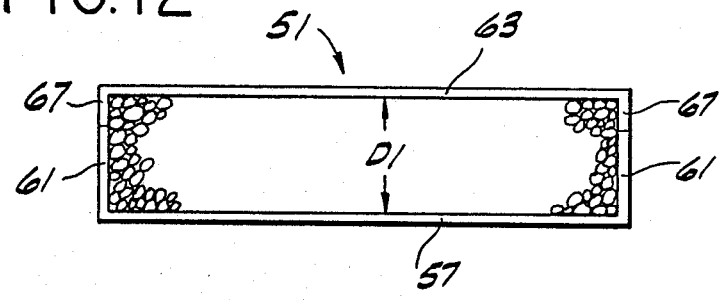
FIG. 12 is a view similar to FIG. 11 showing the bag shaping means closed and compressing the bag to shape it to fit in the carton.
Figure 13:
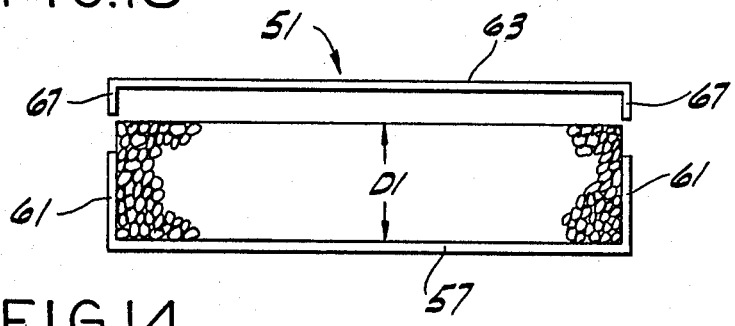
FIG. 13 is a view similar to FIG. 12 showing the bag shaping means open and the bag in its shape as compressed for deposit in the carton.

The mandrel 13 is preferably one of uniform cross section throughout its length (height), with the cross section such as to enable the forming of the web W into tubing T there around using a simplified forming shoulder, avoiding wrinkling, and without the need for a lengthy transition from one cross section to another. Thus, the mandrel 13 may be one which, throughout its length, is of the nonrectangular hollow transverse cross section shown in FIG. 8 having a front 39 and semi-circular sides 43, and being open at the back as indicated at 45. As illustrated, it is of relatively short length (height). The girth of the mandrel is selected in accordance with the girth of the bags to be formed. Extending down from each of the semi-circular sides of the mandrel is a pair of rods 47, the two rods of each pair being spaced in front-to-back direction (front-to-back relative to the carton C and relative to the bag to be formed and deposited in the carton) a distance substantially less than the front-to-back dimension or depth D1 of the carton. These rods are components of means for forming gussets or intucks G in the tubing T as shown in FIG. 9, the gussets being tucked in by means of gusset tuckers as indicated at 48 at a point in the cycle of operation as will appear. Air cylinders for operating the tuckers are indicated at **48*c*. The sealing bars 17 operate in a horizontal plane immediately below the lower ends of these gussetting rods. That portion of the tubing T extending down from the lower end of the mandrel on the outside of the rods 47 is confined by rods 49**.

The bag length at the lower end of the tubing T, containing product, is unconfined as it is fed downwardly between the opened sealing bars 17 on each cycle and is bulged out in front-to-back direction (relative to the carton) by the product, assuming a shape with a front-to-back dimension D2 (see FIGS. 2, 4, 10 and 11) exceeding the front-to-back dimension D1 of the carton. Thus, at this point, the bag length has a shape that would not readily fit in the carton. In accordance with this invention, there is provided below the sealing bars 17 means indicated in its entirety by the reference numeral 51 for shaping the bag length to fit in the carton by compressing the bag length in front-to-back direction to reduce its front-to-back dimension to relate to the dimension D1. The carton, in its position at the carton loading station 14, is located below the shaping or compression means 51 for receiving a completed filled, sealed and compressed bag from the shaping or compression means when the bag is separated from the tubing, as will appear. The compression means comprises front and back compression members 57 and 63 (below the sealing bars 17) movable relatively to one another in front-to-back direction from an open position (see FIGS. 2, 4, 11 and 13) wherein they are spaced a substantially greater distance than the front-to-back inside dimension D1 of the open carton and adapted for downward movement therebetween of the enlarged product-containing bag length of the tubing at the lower end of the tubing, and a closed position (see FIGS. 1, 3, 5, and 12) for the compression shaping of said enlarged bag length. The compression members 57 and 63 may also be referred to as shaping box members. More particularly, the front compression member 57 comprises a flat plate 57 which is carried by a bar 58 secured in fixed position on a pair of supporting rods such as indicated at 59, this plate being provided with rearwardly extending side walls 61 the inside faces of which are spaced a distance corresponding to the carton width. The side walls 61 have a front-to-back dimension somewhat less than the carton inside depth. The rear compression member 63 comprises a flat plate 63 which is carried by a slide 64 slidable in front-to-rear direction on rods 59 between an open position such as shown in FIGS. 2, 4, 11 and 13 and a closed position such as shown in FIGS. 1, 3, 5 and 12. Plate 63 has forwardly extending relatively narrow side walls 67 generally in the plane of side walls 61 of the front plate 57, the front edges of these walls 67 being engageable with the rear edges of walls 61 when plate 63 is moved to its closed compression position for compressing the bag length against plate 57. At 69 is indicated an air cylinder for reciprocating plate 63 back and forth on rods 65 between its open and closed position. Compression member 63 when closed forms with member 57 a box of inside rectangular shape slightly smaller than the inside rectangular shape of a carton C. The arrangement is such that with the sealing bars 17 and the front and back shaping or compression members 57 and 63 open, the bag length of the tubing at the lower end of the tubing, containing product, enlarged in front-to-back direction relative to the front-to-back dimension D1 of the carton, may be fed downwardly between the front and back shaping or compression members and the latter may then be closed to compress the enlarged bag length (i.e., to squeeze it) to shape it to conform to the shape of the interior of the closed compression members. That shape, as noted, is a rectangular shape generally slightly smaller than the rectangular shape of the interior of the carton in horizontal cross section for the subsequent deposit of the bag B completed by sealing at the top of the bag length as indicated at S2 (see FIG. 4) and severing of the bag from the tubing, as will appear.

Figure 2:
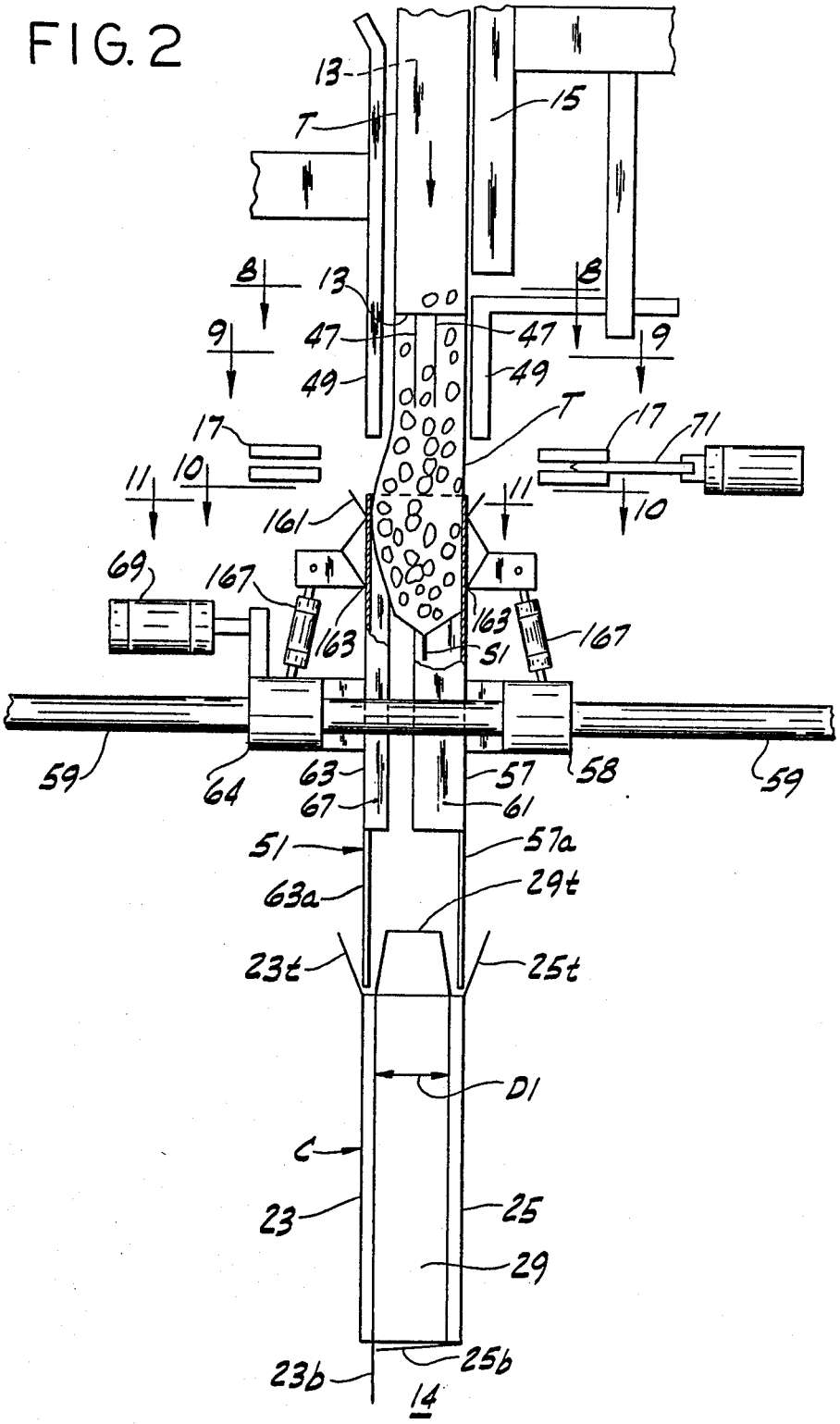
FIG. 2 is an enlargement of part of FIG. 1 showing a further phase of the operation.
Figure 4:
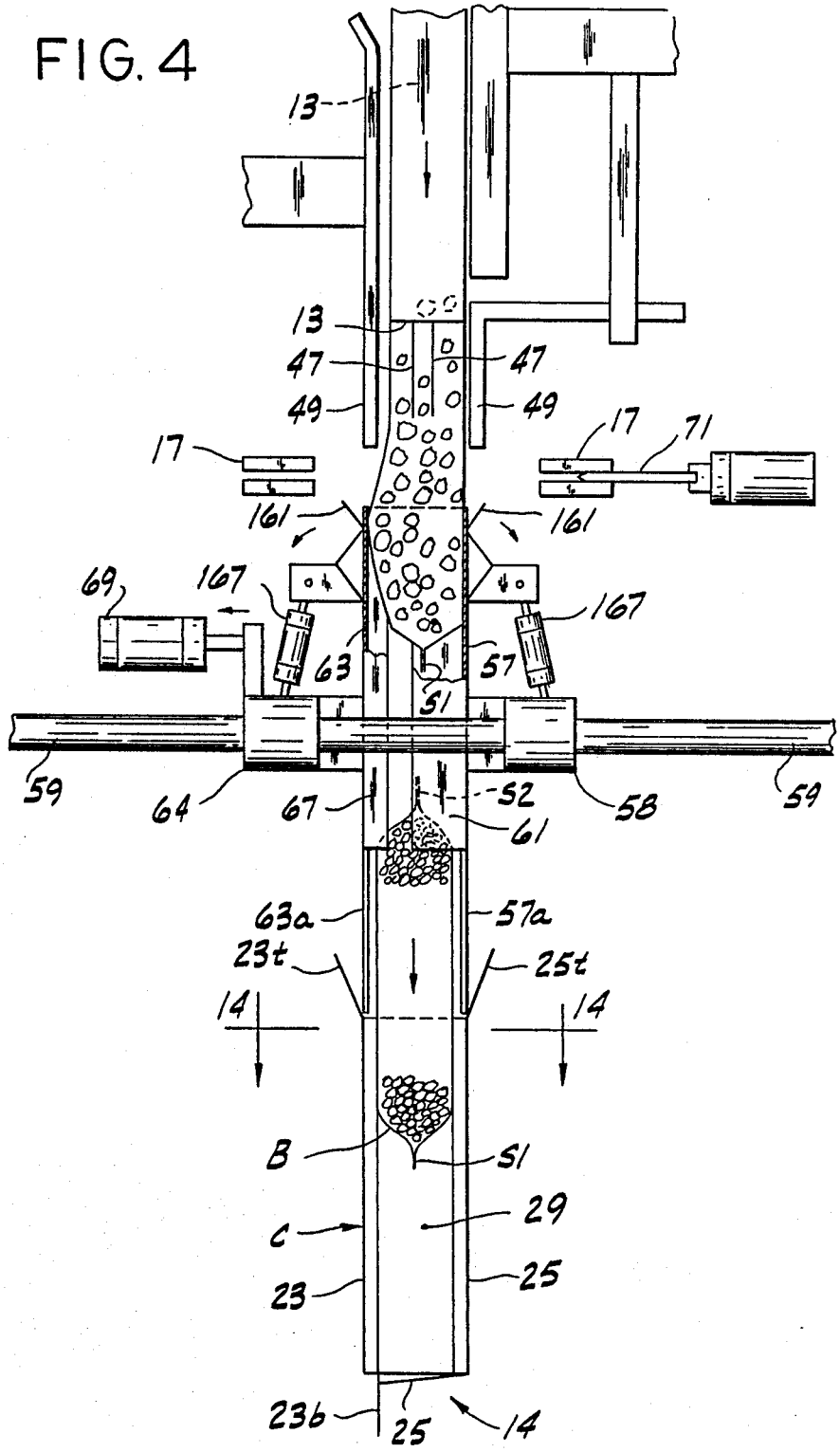
Figure 14:
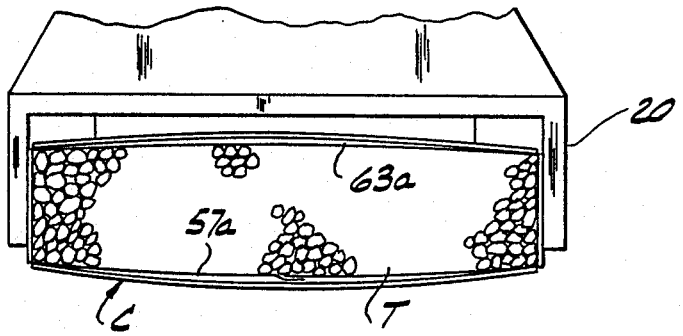
FIG. 14 is an enlarged horizontal section generally on line 14—14 of FIG. 4 showing the bag dropping into the carton.

To facilitate the descent of the bag B, shaped by compression as above described, into the carton at station 14, provision is made for expanding the carton in front-to-back direction. In this regard, the compression plates 57 and 63 are provided with downward extensions 57*a* and 63*a*, which extend down to a level just above the level of the hinged junctures of the top closure flaps 23*t*, 25*t*, 27*t* and 29*t* and the carton walls 23, 25, 27 and 29. The side walls 61 and 67 on plates 57 and 63 are omitted from these extensions, which are slightly curved in horizontal section as viewed in FIG. 14. At the trailing side of these extensions at their lower ends are plows 57*p* and 63*p* for swinging the top major top closure flaps 23*t* and 25*t* of a carton outwardly as the carton is conveyed to the carton loading station 14. The arrangement is such that, with the major top closure flaps on the outside of the lower ends of extensions 57*a* and 63*a*, the extension 63*a*, moving out with plate 63, effects expansion of the carton in front-to-back direction as illustrated in FIGS. 2, 4 and 14 to facilitate the descent of a bag into the carton.

The carton conveyor 18 is an endless conveyor such as disclosed in the aforesaid Langen U.S. Pat. No. 4,642,975 comprising endless chains such as indicated at 68*a* and 68*b* in this patent carrying a series of carton holders 20 spaced at equal intervals therealong through an endless generally horizontal and generally square path as appears in FIG. 6. This path has four straight reaches and four rounded corners. The chains are movable intermittently to bring a carton holder 20 from a carton delivery station 12, where a carton C is delivered to the holder from a magazine as will appear, being opened ("set-up") from a flat, collapsed configuration for placement in the holder, to the carton loading station 14 where the carton is directly below and in line with the shaping or compression means 51. From the carton loading station 14, each carton C with a bag B therein is conveyed through a series of stations as will appear from U.S. Pat. No. 4,642,975 to a carton discharge station 16, the carton being sealed at top and bottom as disclosed in said patent. The carton holders 20 are removably mounted as shown in said patent on the outside of the chains, each having what amounts to a back wall 75 and side walls 77 extending forward (outward) from the back wall spaced a distance corresponding to the width of a carton, the holder being open at its outside or front (relative to the conveyor) as indicated at 79 for insertion at station 12 of an opened carton thereinto from the outside, and removal at station 16 of a carton with a bag therein toward the outside. The conveyor is intermittently operable, as in said U.S. Pat. No. 4,642,975, to index the holders one interval or step on each cycle of operation in such manner that a holder 20 moves into position at the delivery station 12 and dwells there for placement of a carton therein from the outside or front, and another holder, shown in FIG. 6 as the holder which leads the first-mentioned holder two intervals, moves into position at the carton loading station 14. Means indicated generally at 81 is provided at the delivery station 12 for delivering a carton to the holder there, the carton being opened or set up as will appear. Carton supporting bar means similar to that indicated at 30 in said U.S. Pat. No. 4,642,975 is provided for supporting, at the bottom, the cartons being indexed by the conveyor, and carton retaining bar means such as indicated at 28 in this patent is provided for retaining the cartons in the holders.

Figure 20:
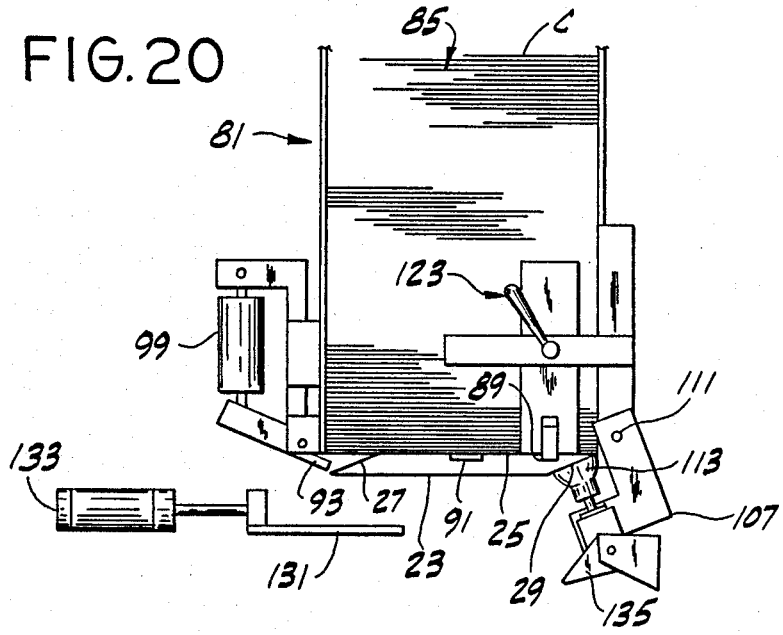
FIG. 20 is a plan of FIG. 19.
Figure 21:
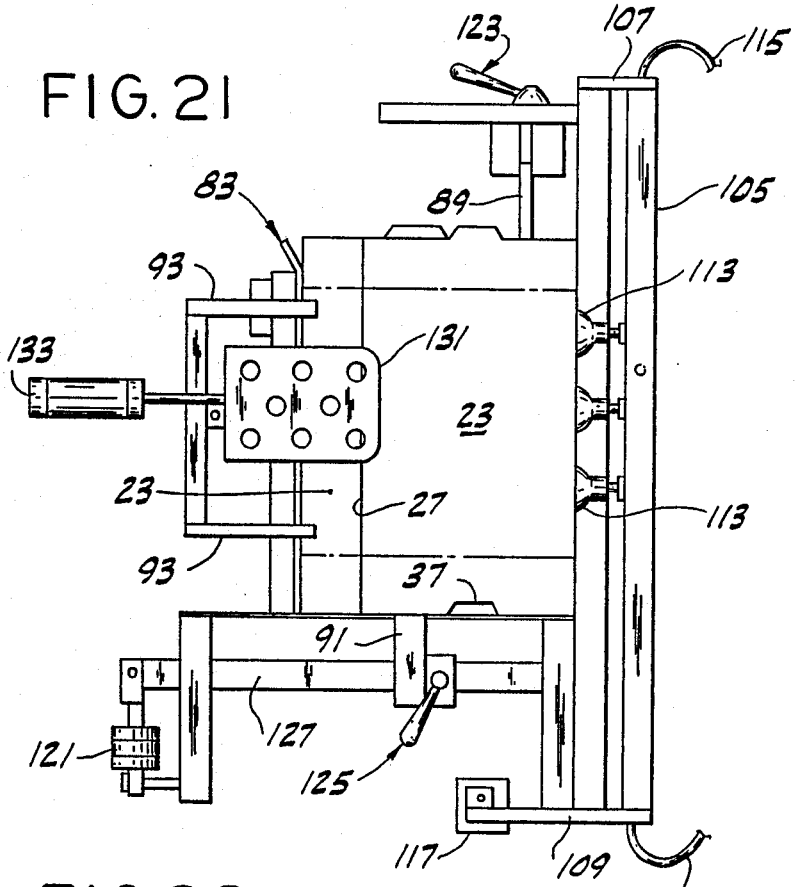
FIG. 21 is a view similar to FIG. 19 showing the carton opening means fully swung back to retracted position and the carton open.

In accordance with this invention, the carton delivery means 81 comprises means 83 which may be referred as a magazine for holding a supply stack 85 of folded-flat cartons C in position on the outside of the conveyor 18 with the stack generally horizontal and extending toward the conveyor generally in alignment with the holder 20 at the delivery station 12, and with the end of the stack which faces toward the conveyor adjacent the open outside or front 79 of that holder. The cartons are so stacked, and the stack is so placed in its horizontal position, that each folded-flat carton in the horizontal stack has its major walls 23 and 25 and its side walls 27 and 29 upright, with side wall 29 of each carton facing toward the conveyor at one side of the stack (its right side as viewed looking outward from the end of the stack toward the conveyor) and the other side wall 27 at the other side of the stack. The stack is laid in horizontal position with the folded-flat cartons C arranged as described on the upper reaches of a set of endless chains 87 (see FIG. 7) constituting means for advancing the stack toward the conveyor as cartons are opened and removed from the forward end of the stack (i.e. its end toward the conveyor) and transferred into the carton holders 20 as they dwell at the carton delivery station 12. The chains 87 are operable by means of a drive such as indicated at 88 in FIG. 7 to move the stack forward to bring the endmost folded-flat carton (specially designated C1) of the stack to a carton opening and transfer position adjacent the conveyor as determined by engagement of the face of the top major closure flap 25*t* which faces toward the conveyor with an upper retractable retainer or stop 89 via the space 35, and engagement of the face of the bottom major closure flap 25*b* with a lower retractable retainer or stop 91 via the notch 37, the upper stop 89 being located in line with a said space 35 and the lower stop 91 being located in line with said notch. The face of wall 23 of carton C1 toward the conveyor engages a pair of upper and lower stop members, each designated 93, which may also be referred to as carton pressure release members, at the said other side of the magazine, i.e. the left side as viewed in FIGS. 15–25. These members are connected by a vertical bar 95 and are pivoted as indicated at 97 for being swung by an air cylinder 99 between a stop position see (FIGS. 15–18) and a release position see (FIG. 20).

Figure 22:
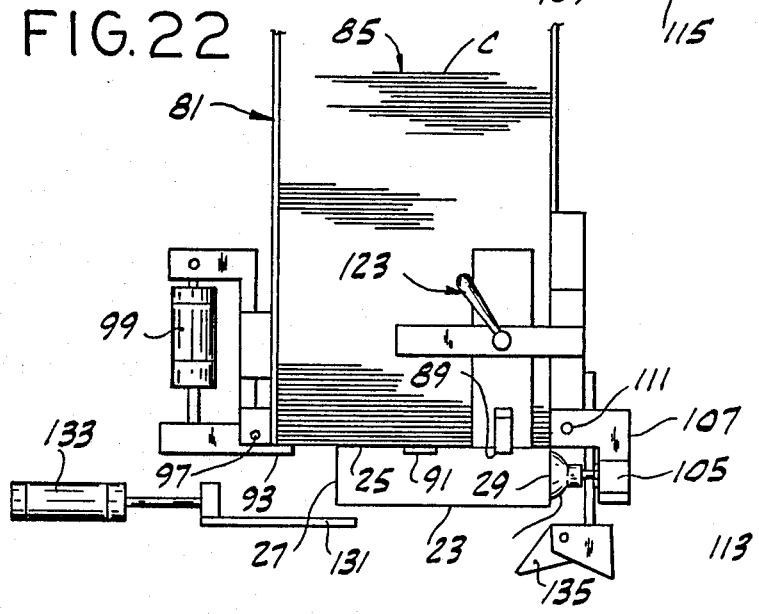
FIG. 22 is a plan of FIG. 21.
Figure 23:
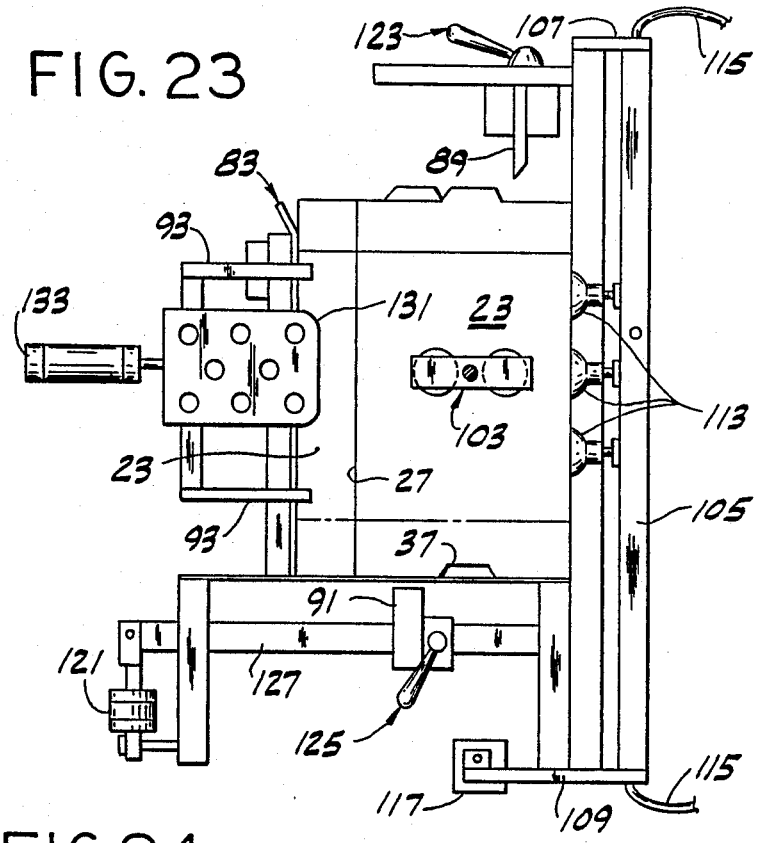
FIG. 23 is a view similar to FIG. 21 showing the opened carton being transferred to a carton holder on the conveyor.
Figure 24:
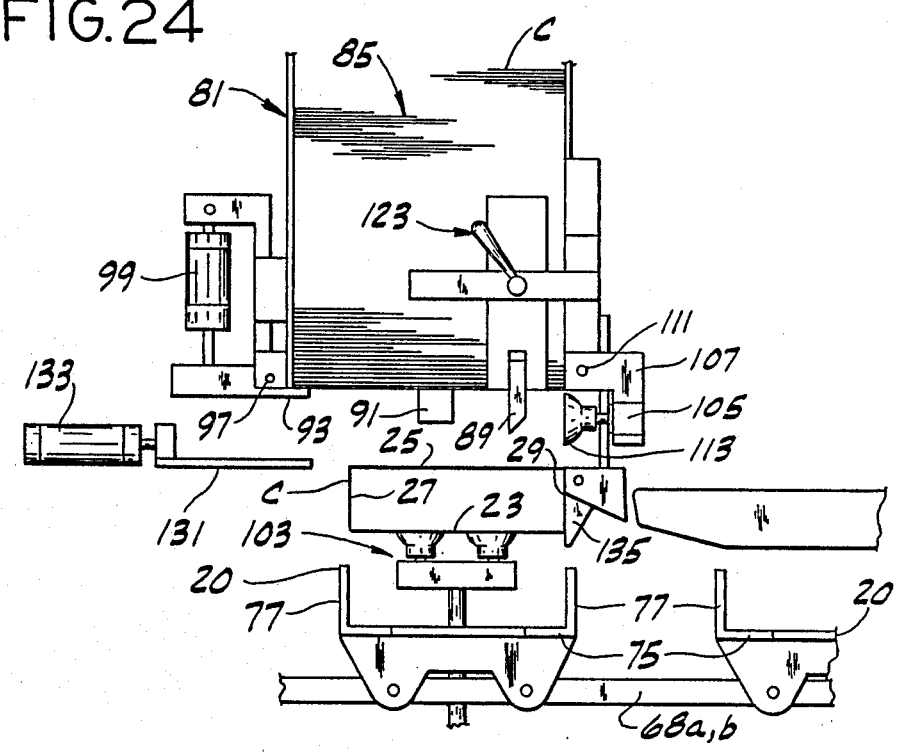
FIG. 24 is a plan of FIG. 23.
Figure 25:
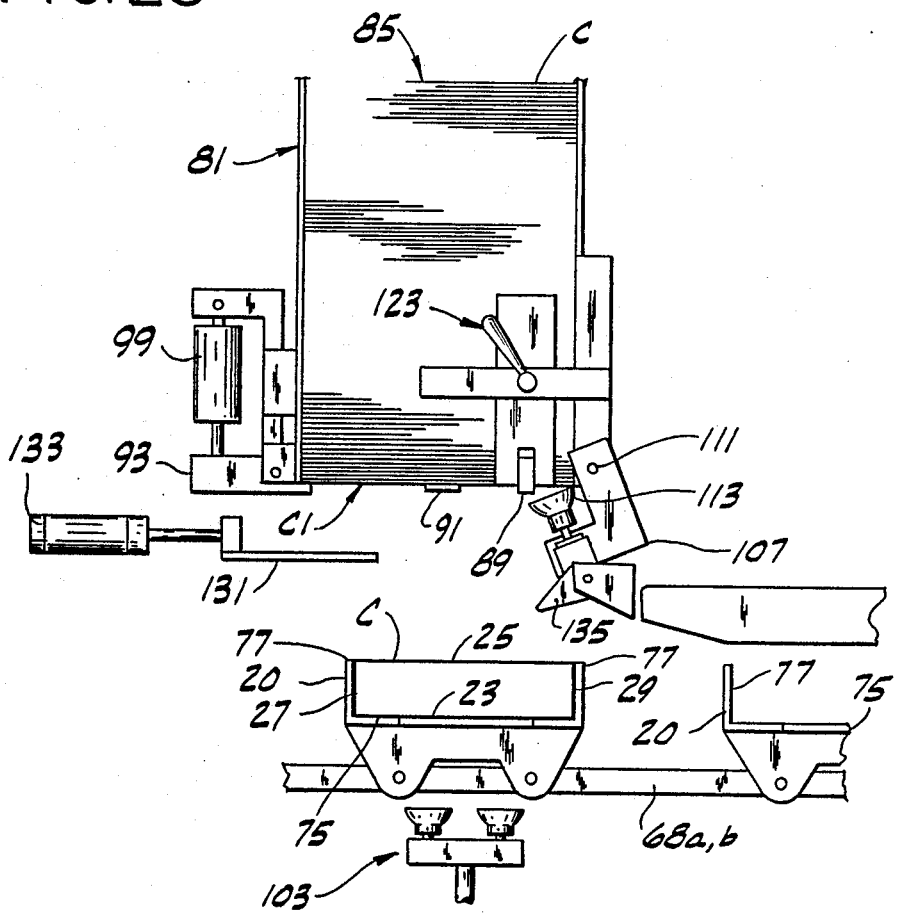
FIG. 25 is a view similar to FIG. 24 showing the opened carton in the carton holder on the conveyor, the conveyor moving the carton holder and carton forward toward the carton loading station, and the carton opening means starting the opening of the next carton, and showing how the carton is held in the holder.

At the said one side of the magazine 83 (its right side as viewed in FIGS. 15–25) and at its end toward the conveyor 18 is a vacuum gripper means 101 for opening the endmost carton C1, this gripper means being movable from a retracted position at the said one side of the magazine (see FIGS. 15 and 16) to a position in vacuum gripping engagement with the exposed face of the side wall 29 of the carton (see FIGS. 17 and 18), and back to retracted position to swing side wall 29 away from wall 25 to open position at right angles to walls 23 and 25, walls 23 and 27 being thereby carried to their open position as shown in FIG. 22. The vacuum grip on side wall 29 is releasable when the carton is opened for the drawing of the opened carton into the carton holder 20 at the carton delivery station 12 by a vacuum gripper means indicated at 103 in FIGS. 6, 23 and 24 operable by an air cylinder 104 (see FIG. 6) via an opening at the back of the holder.

Figure 15:
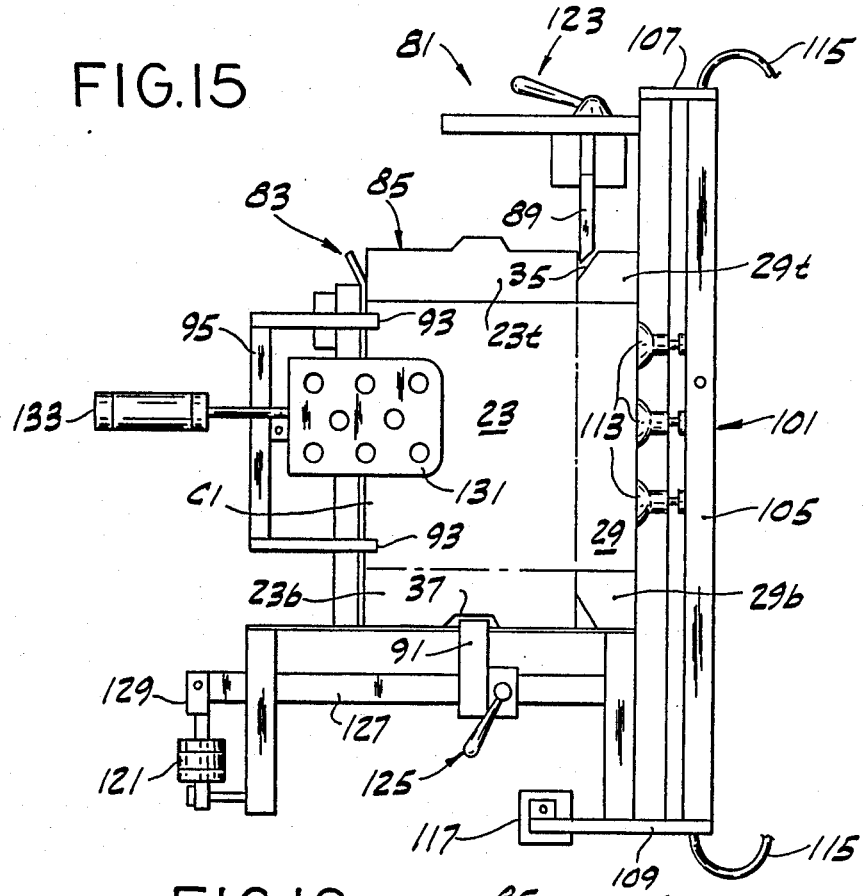
FIG. 15 is a view generally on line 15—15 of FIG. 6 showing the delivery end of the carton delivery means, with a carton opening means of the delivery means in retracted position.
Figure 16:
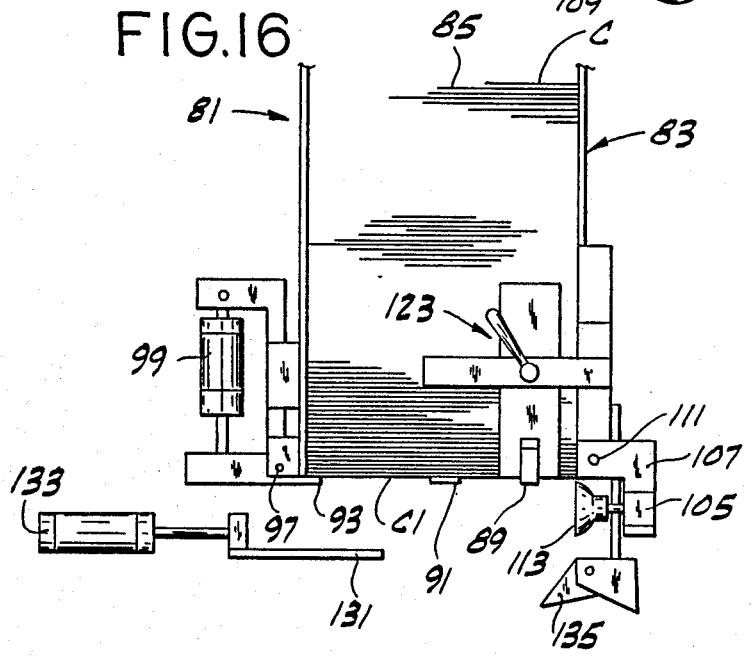
FIG. 16 is a plan of FIG. 15.
Figure 17:
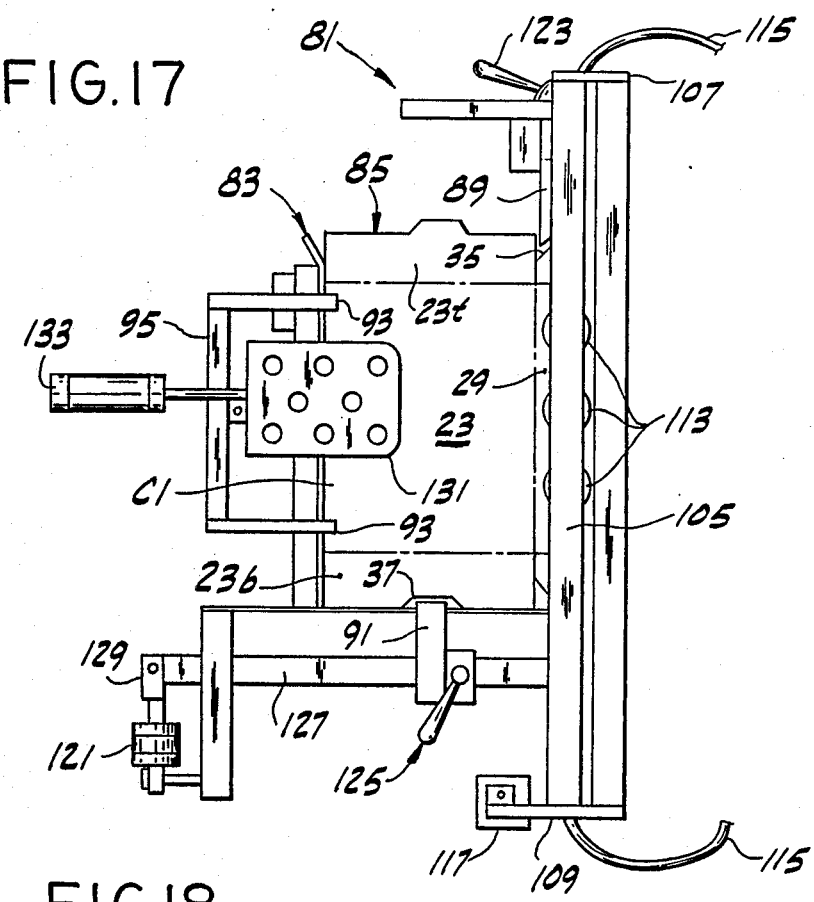
FIG. 17 is a view similar to FIG. 15 showing the carton opening means swung into position to grip a carton for opening it.

The carton-opening vacuum gripper means 101 comprises a vertical hollow bar 105 extending between upper and lower arms 107 and 109 pivoted for swinging movement on a vertical axis as indicated at 111. This bar 105 carries a series of suction cups indicated at 113 in communication with the interior of the bar, the latter being connected by flexible vacuum lines as indicated at 115 to a source of vacuum. The bar 105 is swingable from the retracted position in which it is illustrated in FIGS. 15 and 16 to its carton-flap-gripping position of FIGS. 17 and 18 and back to its retracted position by an air cylinder indicated at 117 connected to the lower arm 109. The upper stop 89 is swingable by an air cylinder 119 between an operative position extending down in front of the top major closure flap **25*t* of the endmost carton C1 of the stack, and a swung-up retracted position clearing that flap. The lower stop 91 is swingable by an air cylinder 121 between an operative position extending up in front of the bottom major closure flap 25*b* and a swung-down retracted position clearing that flap. The upper stop 89 and its cylinder 119 are laterally adjustable as indicated at 123 for handling cartons of different sizes. The lower stop 91 is laterally adjustable as indicated at 125 on a shaft 127, cylinder 121 being connected to a crank arm 129 at one end of this shaft, for handling cartons of different sizes. At 131 is indicated a retractable stop plate which is engageable by wall 23 of the endmost carton C1 of the stack as that carton is opened by the vacuum gripper opener means 101, to prevent the wall 23 from swinging too far. This stop plate is movable laterally with respect to the magazine by an air cylinder 133 between an operative position in front of wall 23 of the endmost carton and spaced therefrom a distance somewhat greater than the carton side wall width (the carton depth) and a retracted position off to the side of the magazine to allow the opened carton to be pulled by the vacuum gripper means 103 into the holder 20 at the carton delivery station 12. At 135** is indicated an anti-back-up latch for the carton operable to prevent the opened .or "set-up" carton from coming out of the holder once it has been pulled into the holder.

Figure 7:
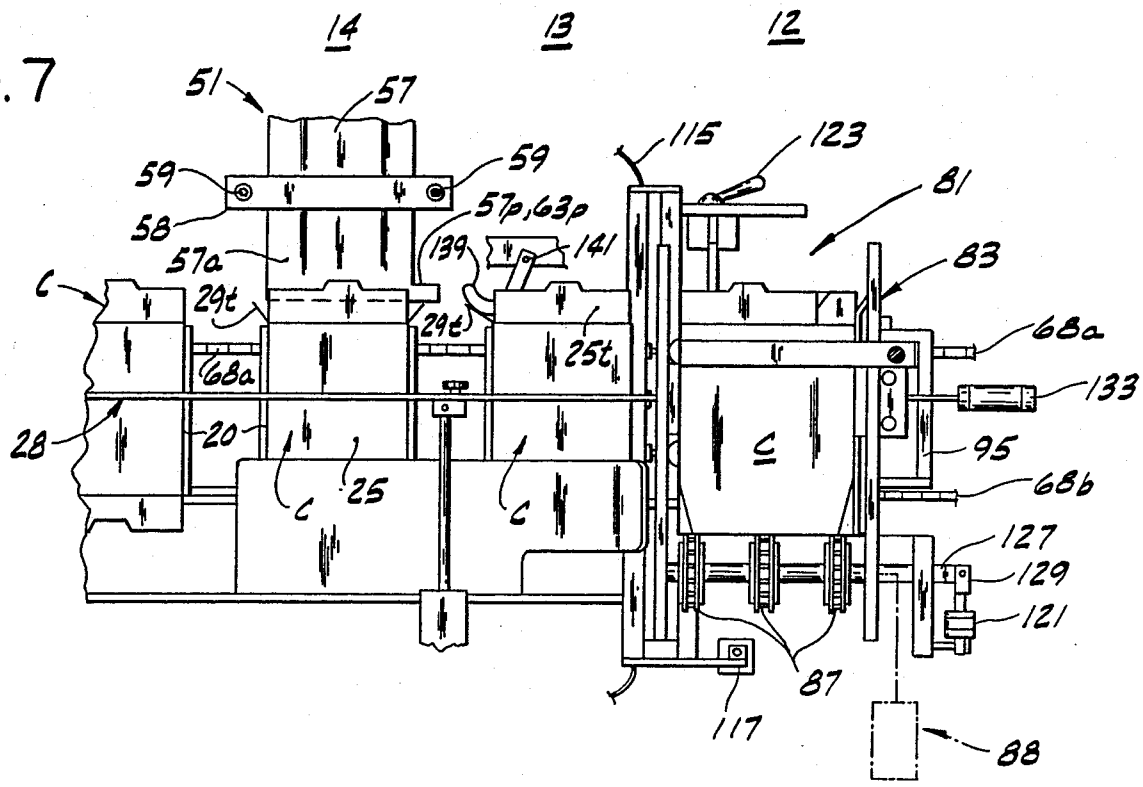
FIG. 7 is a view in front elevation generally on line 7—7 of FIG. 6 showing the conveyor, the means for delivering cartons to the conveyor, certain carton flap opening means, and certain bag shaping means.
Figure 27:
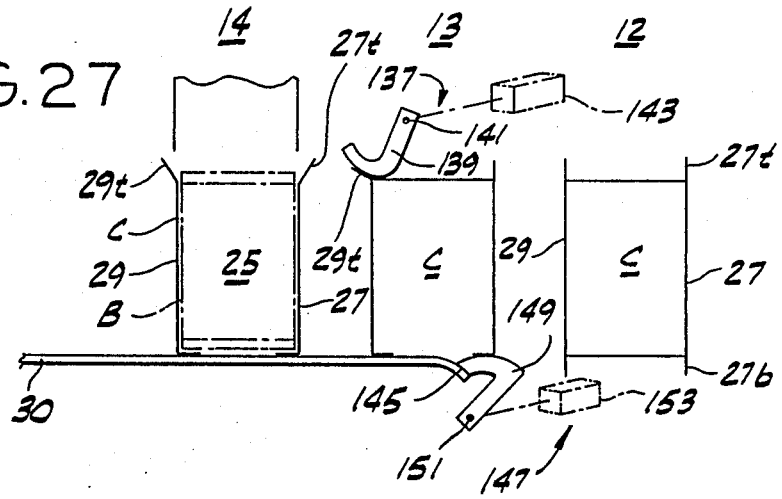
FIGS. 27-32 are views in a series showing how minor closure flaps of a carton are manipulated in the course of travel of the carton from the carton delivery station to the carton loading station.
Figure 28:
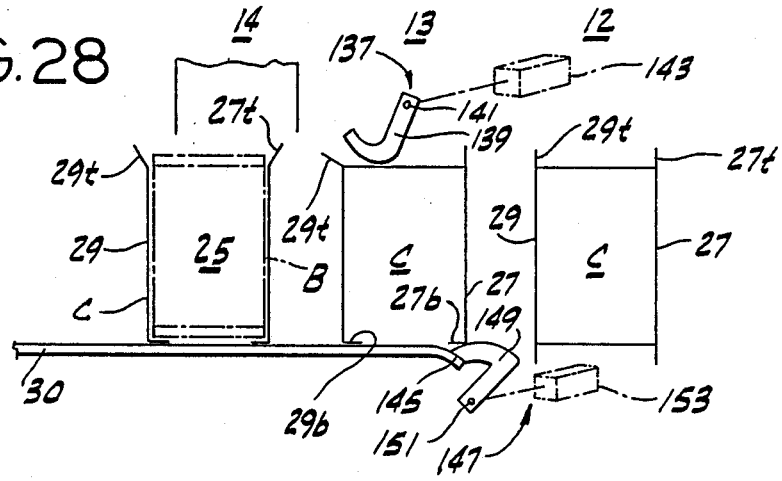
Figure 29:
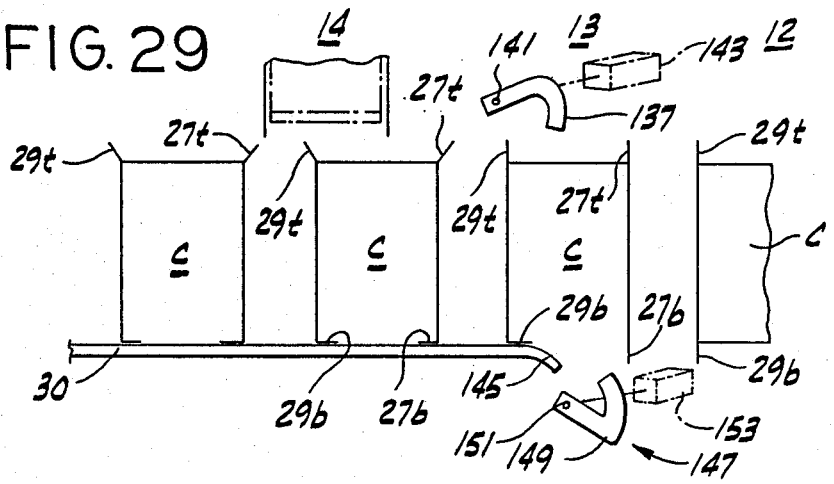
Figure 30:
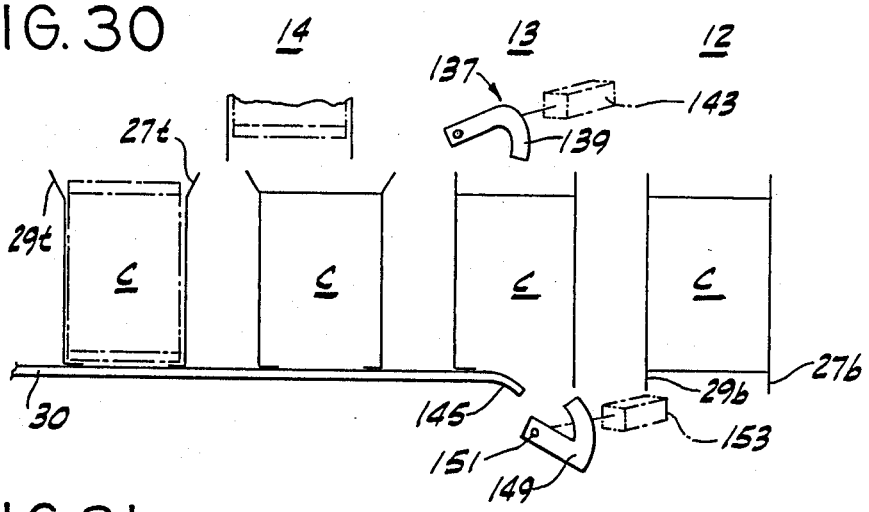
Figure 31:
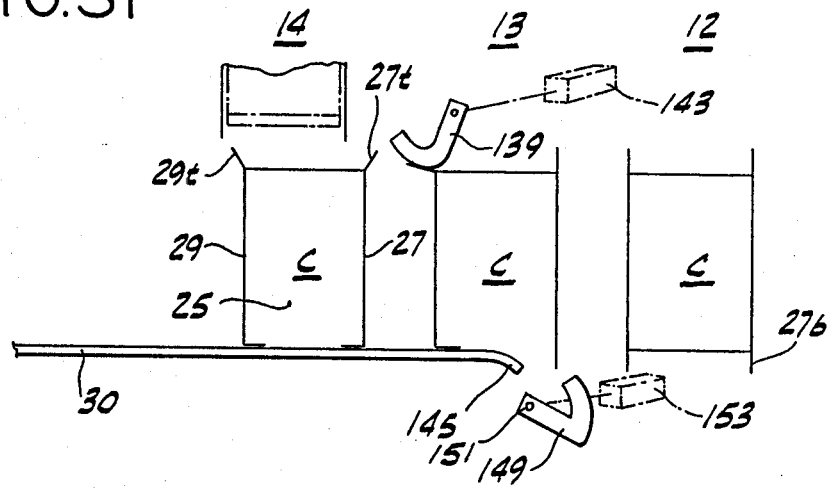
Figure 32:
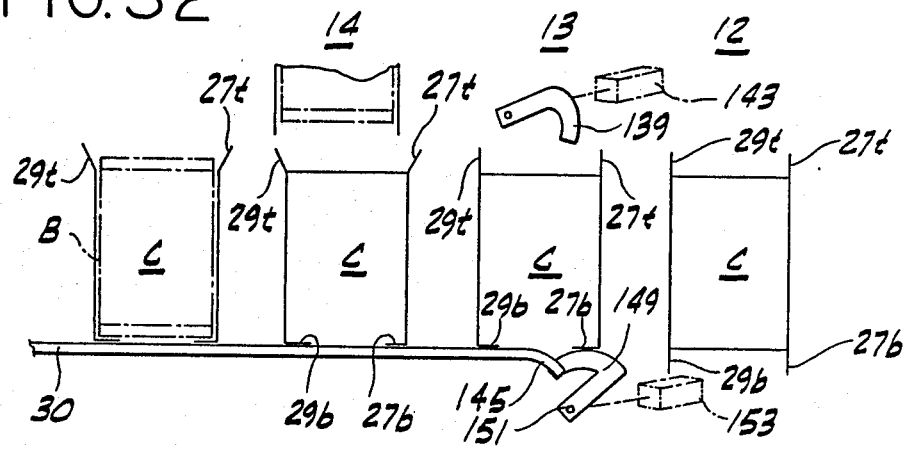

Further in accordance with this invention, the apparatus comprises means 137 for breaking open the top minor closure flaps **27*t* and 29*t* of each carton C as it is fed forward (toward the left as viewed in FIGS. 6, 7 and 27–32) to the carton loading station 14, "breaking open" meaning swinging these flaps out to position them to extend up and outwardly away from the side walls 27 and 29 of the carton so that they converge toward one another in downward direction in funnel-like fashion (note the position of the flaps 27*t* and 29*t* and on the carton C at the carton loading station in FIGS. 7 and 27). This top minor closure flap breaker means comprises a hook-shaped or J-shaped arm 139 pivoted for swinging movement on a horizontal axis 141 extending transversely with respect to the path of travel of the cartons above the level of the upper edges of the top closure flaps and on the trailing side of the bag compression or shaper means 51 adjacent the latter. At 143 is indicated means comprising an air-operated device for swinging the arm between the raised position in which it is shown in FIGS. 29, 30 and 32 and the lowered position in which it is shown in FIGS. 27, 28 and 31. The arm is swingable downwardly (clockwise as viewed in FIGS. 29, 30 and 32) from its raised position as a carton travels thereunder into engagement with the trailing face of the leading minor top flap 29*t* to swing that flap forward (i.e. to break it open). The arm is then swingable back upwardly (counterclockwise as viewed in FIGS. 27, 28 and 31) to its raised position and, as it is so retracted, is engaged by the leading face of the trailing minor top closure flap 27*t* to swing that flap rearward (i.e. to break it open). Having returned to retracted position, the arm 139 is then above the level of the upper edges of the minor closure flaps 29*t*, 27*t* to enable the passage of the leading top minor flap 29*t* thereunder without its being swung back. The top major closure flaps 23*t*, 25*t* are broken open i.e. swung outwardly, by the plow means 57*p*, 63*p* at the lower ends of the downward extensions 57*a*, 63*a* of the compression or shaper box plates 57 and 63**.

The leading bottom minor closure flap **29*b* is plowed closed as the carton travels forward from the carton delivery station 12 by engagement with a curved end 145 of the bottom rail means 30 of the conveyor 18, and the bottom major closure flap 25*b* is closed by a suitable plow via a gap in the bottom rail means 30. The other bottom major closure flap 23*b* is left open to enable air to exit through the lower end of the carton when the bag drops into the carton so that the bag may readily fall all the way to the bottom of the carton. Means indicated at 147 is provided for closing the trailing bottom minor closure flap 27*b* of a carton as it travels forward away from the carton delivery station 12, this means comprising a hook-shaped or J-shaped arm 149 pivoted for swinging movement on a horizontal axis 151 extending transversely to the path of travel of the cartons below the end 145 of the conveyor bottom rail means 30. At 153 is indicated means comprising an air-operated device for swinging the arm 149 between the lowered position in which it is shown in FIGS. 29–31 and the raised position in which it is shown in FIGS. 27, 28 and 32. The arm 149 is swingable upwardly (counterclockwise) as viewed in FIGS. 29–31 from its lowered position to its raised position as a carton travels thereover into engagement with the trailing face of the trailing bottom minor closure flap 27*b* to swing that flap forward to its closed position before it travels onto the rail means 30**, and is then swingable back to its lowered position below the level of the lower edges of the bottom minor flaps to enable the passage thereover of these flaps of the next carton.

Product such as dry breakfast cereal, for example, for delivery down through the mandrel 13 into the lower end of the tubing T to fill a bag, is supplied to the upper end of the mandrel by means of a suitable supply system, diagrammatically indicated at 155 in FIG. 6, of any suitable type but preferably one including a combination weighing scale 157 such as shown in the aforesaid U.S. Pat. No. 4,589,506. This system acts intermittently to supply a measured charge of product (accurately weighed in the case of use of the combination weighing scale) to the upper end of the mandrel, the product dropping down into the mandrel and exiting from the lower end of the mandrel into the lower end of the tubing T which extends down from the lower end of the mandrel around the two pair of gusseting rods 47 and within the confines of the rods 49. Product drop is facilitated by having the mandrel open at 45.

Figure 3:
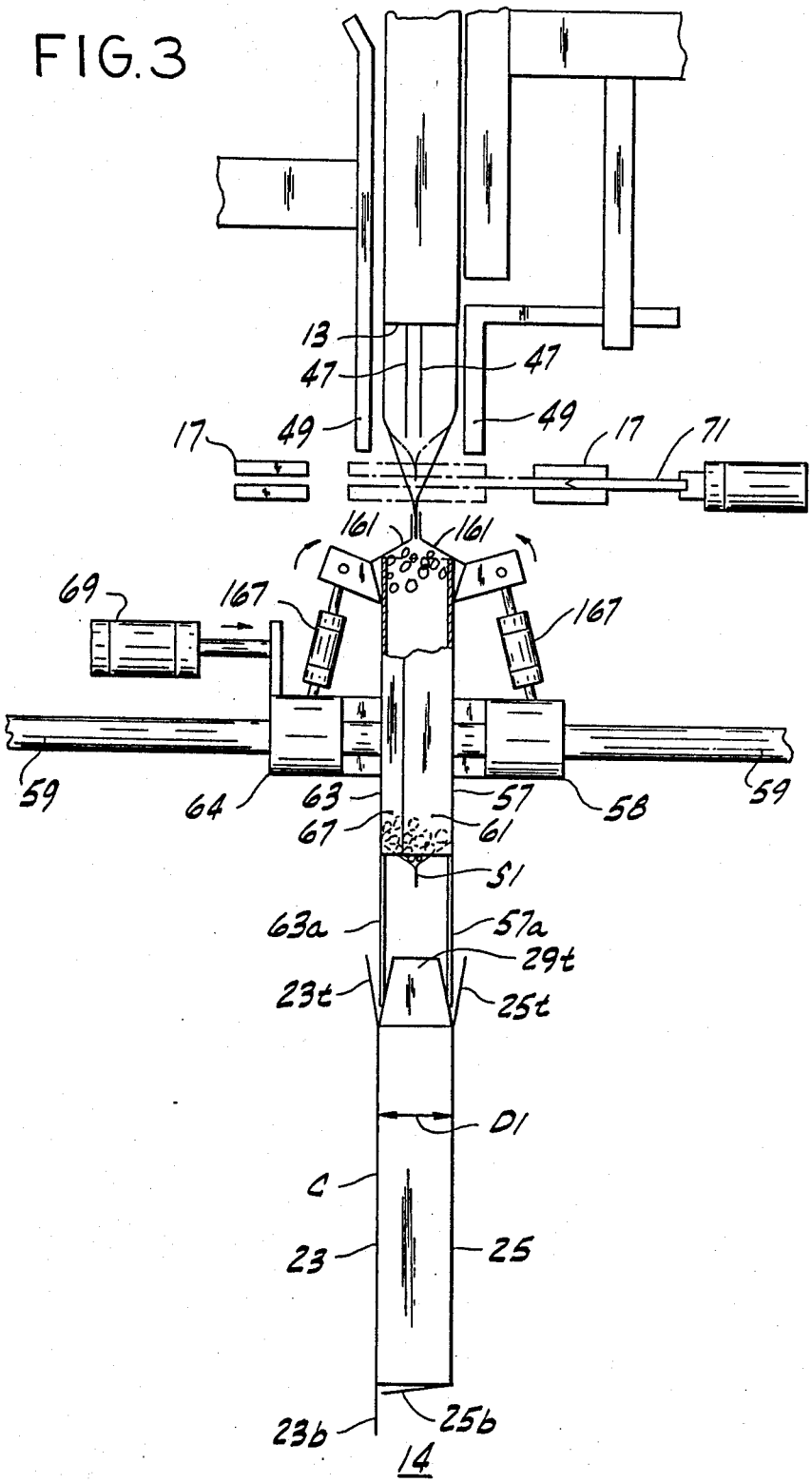
FIGS. 3-5 are views similar to FIG. 1 showing further phases of the operation, FIG. 3 showing in solid lines the sealing bars of the VFFS machine open and in phantom these bars closed.
Figure 5:
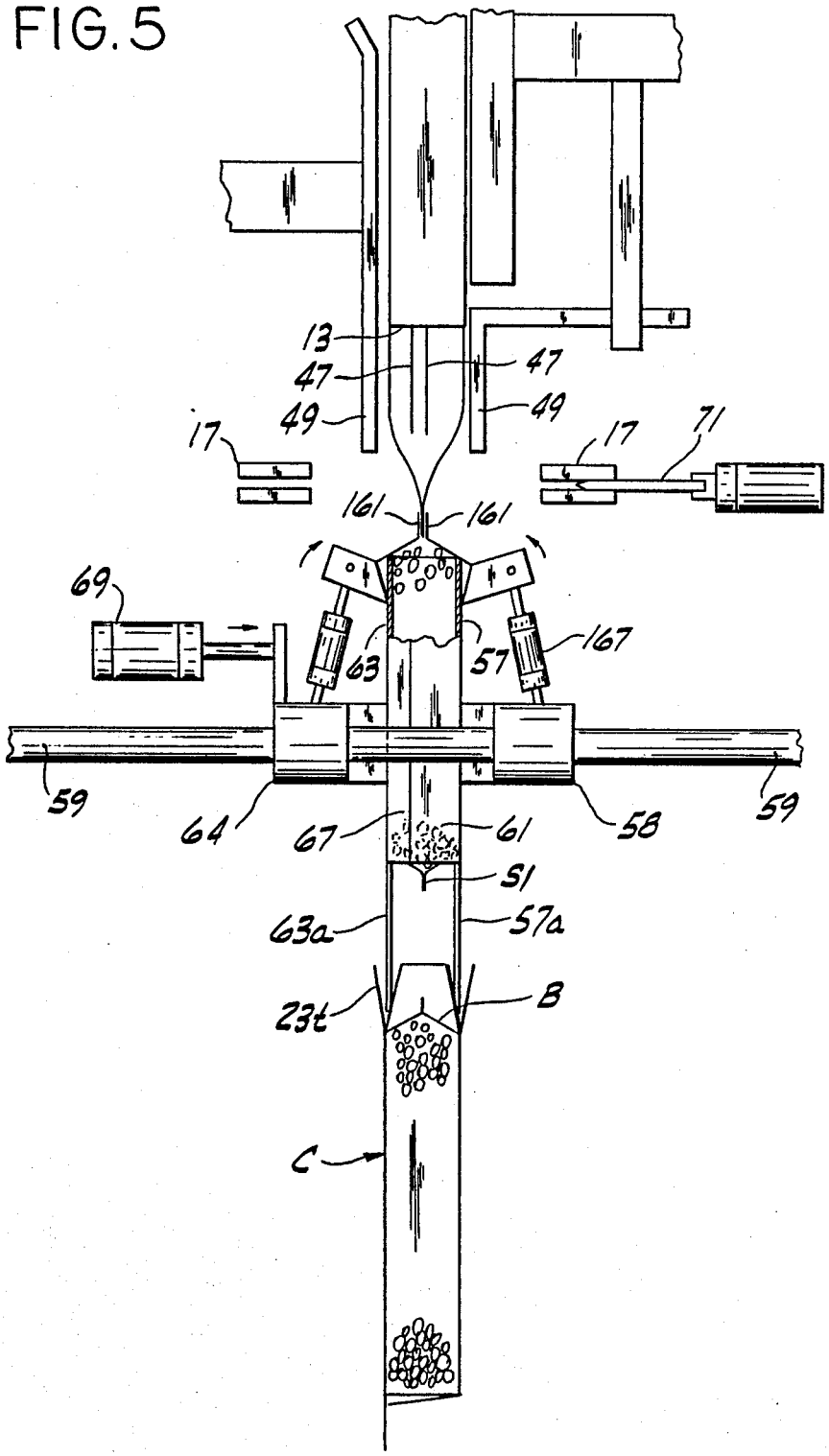
Figure 33:
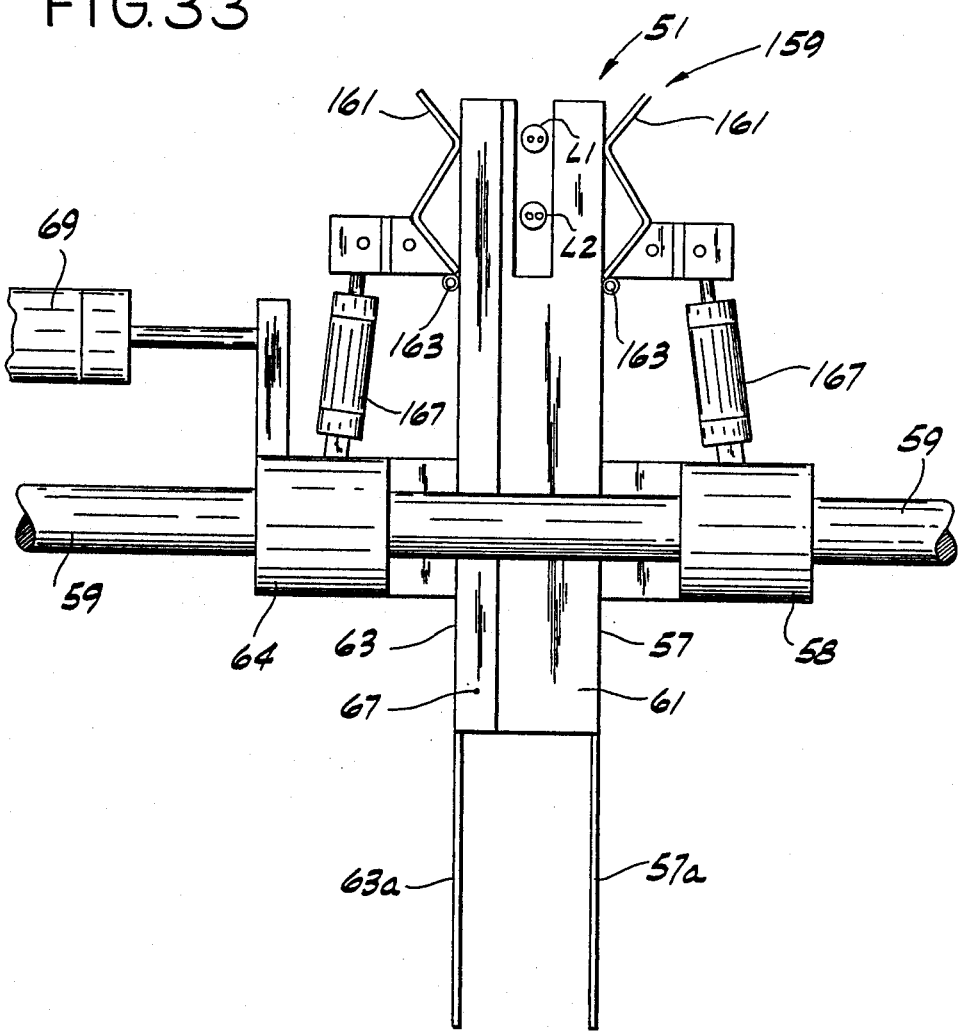
FIG. 33 is an enlarged fragment of FIG. 3 showing details of a deflating and stripping means.
Figure 34:
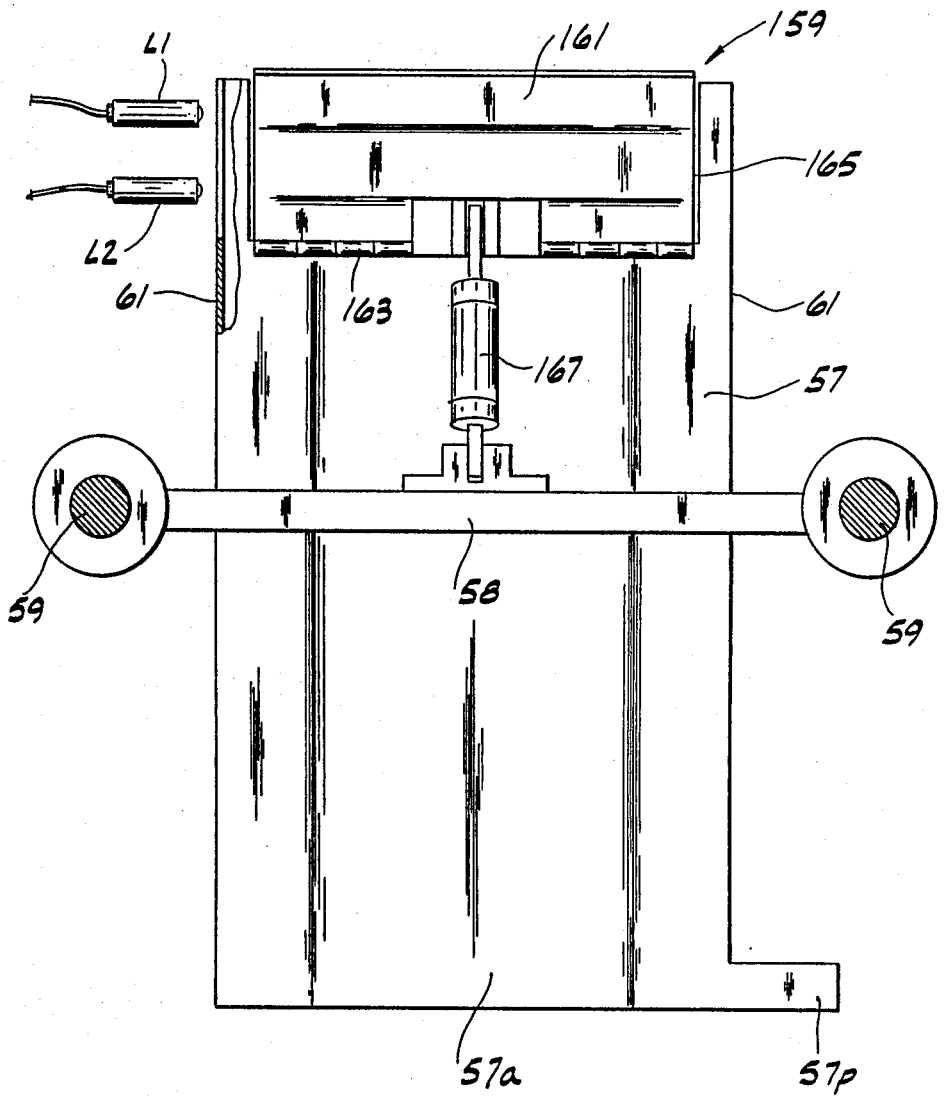
FIG. 34 is a front elevation of FIG. 33.

At 159 is indicated means for deflating and striping the bag length of tubing T which has been fed downwardly into the compression means or shaper box 51 and which has received product for the bag to be completed from that bag length. This means, best shown in FIGS. 33 and 34, comprises a pair of plates each designated 161 bent as illustrated best in FIG. 33 hinged as indicated at 163 at their lower edges at the bottom of cutouts 165 at the top of the compression plates 57 and 63. These deflator/stripper plates are adapted to be swung in and out by means of air cylinders 167, acting when swung inwardly as shown in FIGS. 3 and 5 to strip product down away from the upper end portion of the bag length, and to expel air from the upper portion of the bag length and to flatten it to expedite the formation of the seals S2 and S1 at the upper end of the bag length by the sealing bars. FIGS. 33 and 34 also show upper and lower product level sensors L1 and L2 associated with the shaping box 51.

Figure 1:
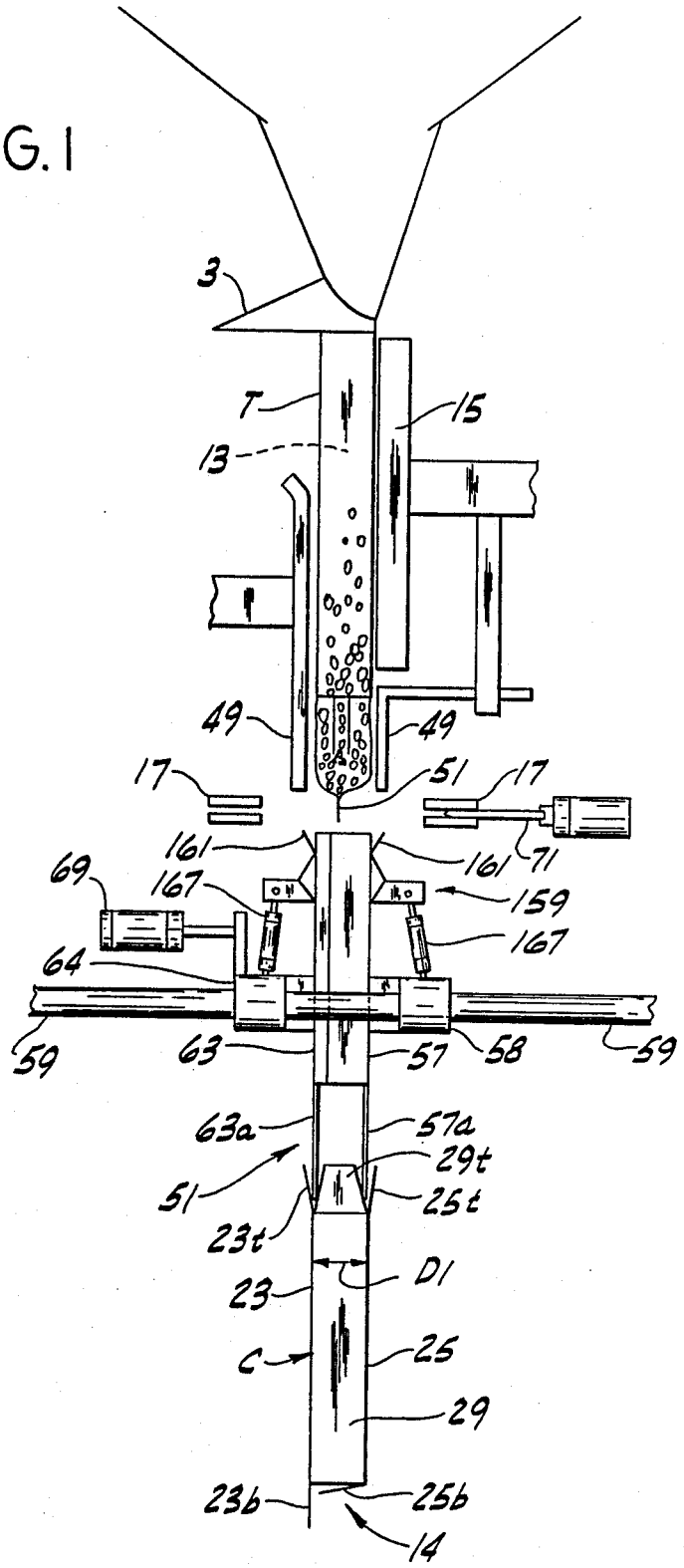
FIG. 1 is a semi-diagrammatic view in side elevation of a VFFS machine such as referred to above with adjuncts including a bag shaping means for shaping bags which are formed, filled and sealed by the machine for deposit in cartons, showing a starting phase of the operation.

The operation of the apparatus is under control of a programmable controller as indicated at 169 in FIG. 6 which controls the electrical components and air valves for controlling the air cylinders of the VFFS machine 1, the conveyor 18, the carton delivery means 81 and the product supply system 155. The operation is in cycles, in each of which the VFFS machine 1 operates to form a bag length of the flexible sheet packaging material into tubing T, and the pull belts 41 feed the tubing downwardly said one bag length off the lower end of the mandrel 13, in the same manner as described in the aforesaid James U.S. patent. This downward feed of the bag length occurs with the sealing bars 17 and the compression members 57, 63 and deflator/stripper plates 161 open. FIG. 1 shows a starting situation with a relatively short length of the tubing sealed at its lower end as indicated at S1 extending down from the lower end of the mandrel, product filling the lower end of the tubing and dropping down in the mandrel the sealing bars 17 being open, the compression member 57, 63 closed, and the plates 161 open. FIG. 2 shows the sealing bars, the compression members, and the deflator/-stripper plates all open, and the tubing (sealed at its lower end as indicated at S1) being fed downward between the compression plates 57 and 63, delivery of product down through the mandrel 13 into the lower end of the tubing continuing. As illustrated, the lower end of the tubing T is bulged out by its contents, within the confines of the compression plates 57 and 55, thereby limiting the excess of its front-to-back dimension over the front-to-back dimension of the carton.

The downward feed of the tubing T continues until a bag length of the tubing has been fed downwardly, bringing the seal S1 at the lower end of the tubing to the position in which it appears in FIG. 3. The lower end of the tubing, containing product, is bulged out throughout the major portion of its length between the compression plates 57, 63 within the bulging limit imposed thereon by these plates and has a front-to-back dimension D2 exceeding the front-to-back dimension D1 of the carton. With the gussets or intucks, the bag length fits between the walls 61, 67 at one side and walls 61, 67 at the other side of the shaping box, these walls acting to limit lateral expansion of the bag length. Following the completion of the downward feed of the bag length, and during the ensuing dwell of the tubing the compression plate 63 is moved toward the compression plate 57 to compress the enlarged bag length in front-to-back direction to shape it to fit in the carton, the bag length being squeezed between plates 63 and 57 as shown in FIG. 3 to the point where its front-to-back dimension is slightly less than the front-to-back dimension D1 of the carton. The deflator/stripper plates 161 are closed as shown in FIG. 3 to strip the product down in the bag length of tubing away from its upper end and to deflate and flatten the bag length at its upper end. The gusset tuckers 48 are closed (see FIG. 9). Then, the sealing bars are closed as shown in phantom in FIG. 3 to seal the tubing transversely across its width so as to form a top seal S2 for the bag being completed and a bottom seal S1 for the next bag.

While the bag forming, filling and sealing operation is taking place as above described, the conveyor 18 indexes a carton holder 20 with an opened carton C therein to the carton loading station 14, the carton being positioned below and generally in line with the bag being formed. The major top closure flaps **23*t* and 25*t* of the carton come into position on the outside of the extensions 57*a* and 63*a* of the compression plates 57 and 63 at their lower ends. The minor top closure flaps 27*t* and 29*t* are open, having been opened by the arm 139. The major bottom closure flap 25*b* and both minor bottom closure flaps 27*b* and 29*b* are closed, but the major bottom closure flap 23*b*** is open (for venting the carton).

Following the formation of the top seal S2 for the bag being completed and the bottom seal S1 for the next bag, the knife 71 is operated to sever the tubing between these seals to separate the completed filled, sealed and compressed bag B from the tubing T. The sealing bars 17, the plate 63, and the deflator/stripper plates 161 are then opened as shown in FIG. 4 for the descent of the bag B, severed from the tubing and released by reason of the opening of the plate 63, into the carton C, the descent being a gravity descent by free fall between plates 57 and 63 and their extensions **57*a* and 63*a* to expedite the drop of the bag into the carton. As the plate 63 is opened, the lower end of extension 63*a* of this plate functions to expand the carton to some extent. FIG. 4 shows the bag in the course of its drop into the carton, also showing how the carton is spread open slightly to expedite the bag drop. With the major bottom closure flap 23*b* of the carton open, air may escape from the carton through its lower end to avoid compression of air in the carton by the bag as it drops into the carton. FIG. 4 also shows how, as the completed bag B is dropping, the next bag length is being fed down between the opened sealing bars 17, plates 57 and 63 and plates 161. FIG. 5 shows the completed bag all the way down in the carton and the next bag length all the way down between the plates 57 and 63, also showing plate 63 closed for the compression of the bag length, and the plates 161 closed (as in FIG. 3). With the plate 63** closed, the carton C contracts to its original configuration. During its drop, the bag retains its compressed shape, which is its shape for fitting in the carton.

Figure 18:
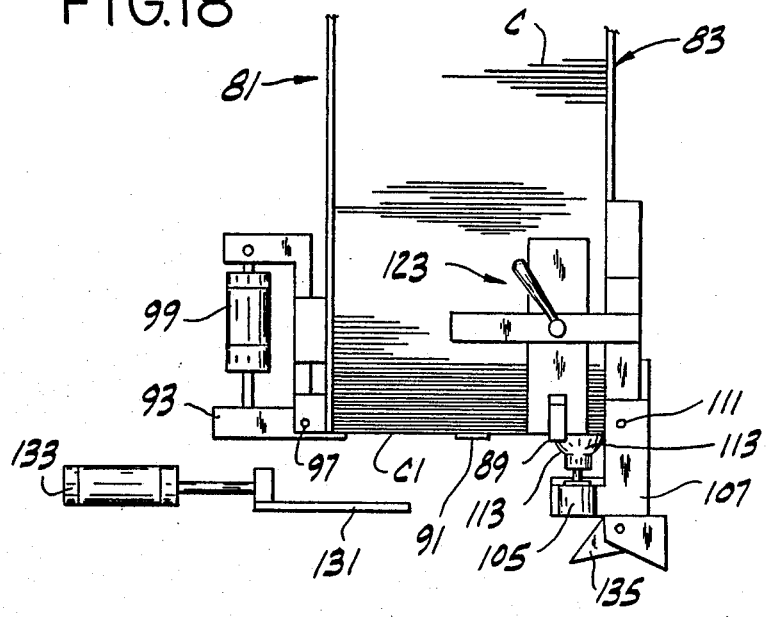
FIG. 18 is a plan of FIG. 17.
Figure 19:
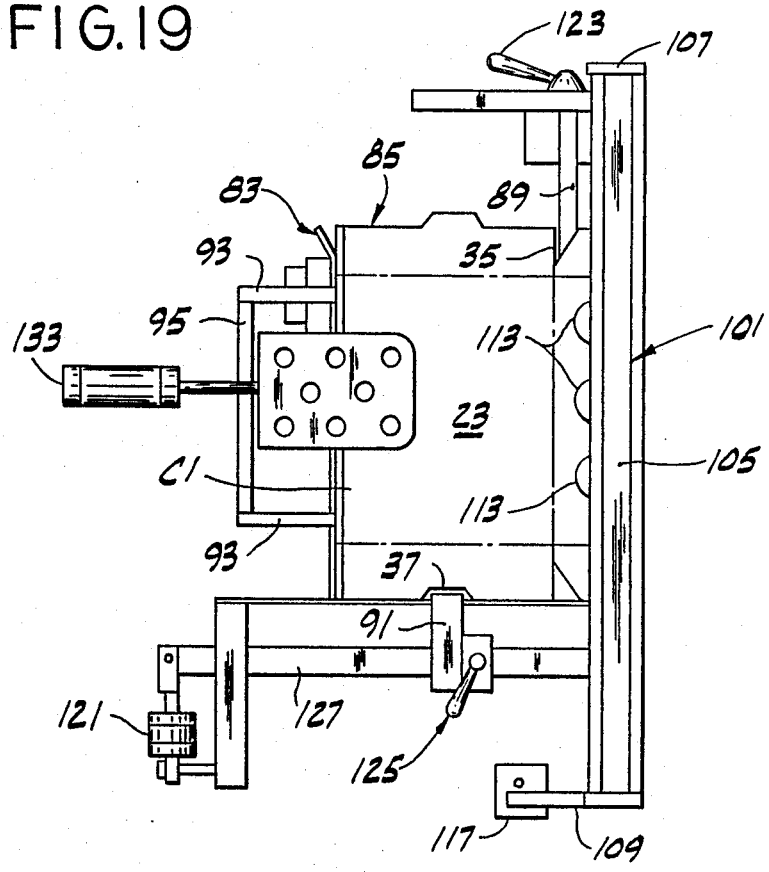
FIG. 19 is a view similar to FIG. 17 showing the carton opening means swinging back to open the carton.

During the dwell of the conveyor 18, while a bag is being loaded into a carton C at the carton loading station 14 as above described, the endmost carton C1 in the magazine 83 is opened (set up) and transferred, after it has been opened, into the carton holder 20 dwelling at the carton delivery station 12. The carton C1 is opened by swinging the bar 105 carrying the suction cups 113 from its retracted position of FIGS. 15 and 16 for engagement of the cups with the side wall 29 of carton C1 as shown in FIG. 18. The vacuum is then turned on for the gripping of wall 29 by the cups, and the bar 105 is swung back to its retracted position to open the carton C1 (see FIGS. 20 and 22), the carton pressure release members 93 being released to allow this. While the carton is being opened, the stops 89 and 91 are in their operative position holding back the closure flaps **25*t* and 25*b*. When the carton has been opened, the stop plate 131 is retracted, the vacuum gripper means 103 is moved into engagement with carton wall 23, vacuum is applied so that this gripper means grips the carton, and then the gripper means is drawn back to pull or draw the opened carton into the carton holder 20 at station 12 (see FIGS. 23 and 24**).

Upon completion of the loading of a carton with a bag at station 14 and the completion of delivery of an opened carton into a holder 20 at station 12, the conveyor 18 is indexed forward one step. This brings a holder 20 with an opened carton therein from the intermediate holder dwell position or station 13 between station 12 and station 14 to station 14 and brings the holder 20 in which an opened carton has just been placed at station 12 from station 12 to said intermediate station 13. As the latter holder 20 indexes forward from station 12, bar 105 swings to open the next carton, and the carton in holder 20 is retained in the holder by the anti-back-up latch 135. As the carton progresses from station 12 to station 13, the leading minor bottom closure flap **29*b* is swung closed by engagement thereof with the end 145 of the bottom rail means 30 (as appears best in FIG. 29) and is subsequently maintained closed. The trailing minor bottom closure flap 27*b* is swung closed by the arm 149 and subsequently maintained closed. The major bottom closure flap 25*b* is swung to closed position by a plow via a suitable gap in the bottom rail means 30. As the carton progresses from station 13 to station 14, first the leading minor top closure flap 29*t* is broken open (swung forward) by the arm 139, and then the trailing minor top closure flap 27*t* is broken open (swung rearward) by the arm 139, as shown in the sequence of FIGS. 27–29**.

Each carton C, having had a filled, sealed and compressed bag B deposited therein at the carton loading station 14, is then indexed forward in steps from that station, ultimately reaching the carton discharge station 16. In the course of its travel from station 14 to station 16, the major bottom closure flap **23*b* is folded up and adhered to the major bottom closure flap 25*b*, the minor top closure flaps 27*t* and 29*t* are swung over into their closed position, the major top closure flap 25*t* is folded over to its closed position, and the major to closure flap 23*t* is folded over and adhered to the flap 25*t*, in a manner similar to that shown for the closure of the carton in the aforesaid U.S. Pat. No. 4,642,975. Finally, each loaded and closed carton is discharged from its holder 20 at the discharge station 16, and that holder subsequently returns to the carton delivery station 12** to repeat its circuit around the aforesaid square path.

It will be observed that the conveyor 18 is operable to bring an opened carton C from station 13 to station 14 while a bag B is being formed, the carton arriving at station 14 in position for receiving a bag being formed just before the bag is segmented from the tubing T by the knife 71. It will also be observed that the carton opening means 101 is operable to open a carton and have it ready for transfer to a holder 20 at the carton delivery station 12 while the conveyor 18 is in motion. The apparatus is adapted for ready change-over to form bags of different sizes and load them in cartons of correspondingly different sizes by changing mandrels, changing compression members 53 and 55, and changing carton holders 20, adjusting the carton delivery means 81, and adjusting the conveyor 18 as described in U.S. Pat. No. 4,642,975.

Figure 35:
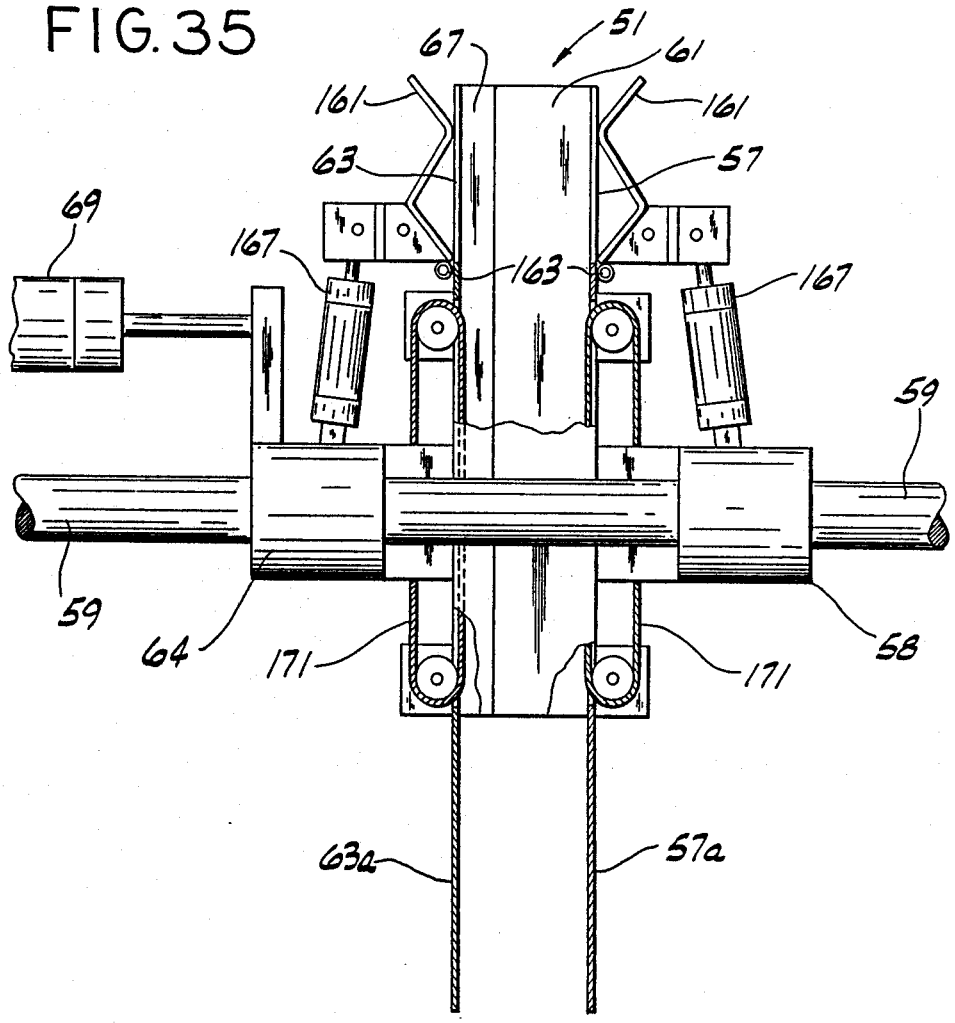
FIG. 35 is a view similar to FIG. 33 showing a modification having belts for driving the bags down into the cartons.
Figure 36:
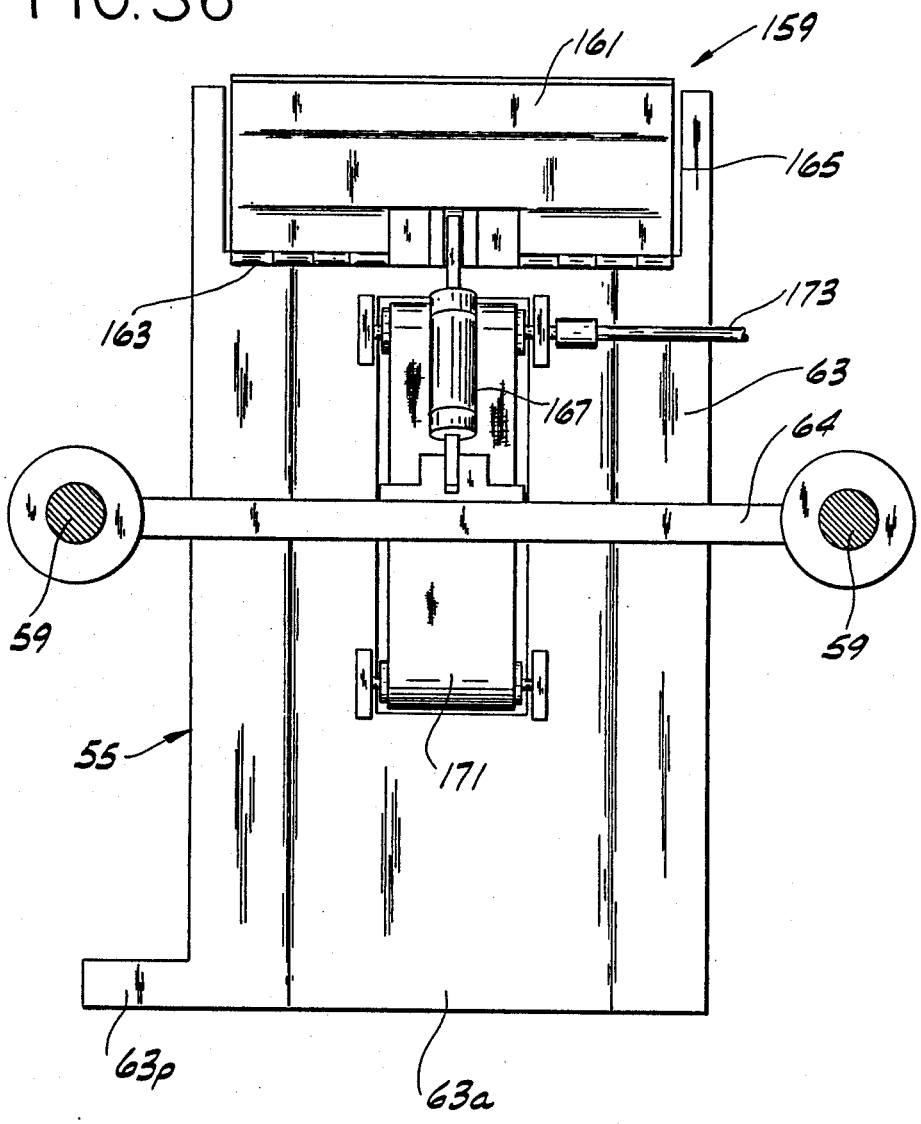
FIG. 36 is a view in elevation from the left of FIG. 35.

FIGS. 35 and 36 illustrate a modification in which the compression plates 57 and 63 are provided with pull belts 171 for positively driving the completed bag down into the carton. A flexible wire drive such as indicated at 173 is provided for driving the belt on the movable plate 63, permitting its movement between its open and closed positions, and a similar or any other suitable drive may be used for the belt on the other plate. The belt drives are activated when the plates have been closed to compress the bag length therebetween and after the bag length has been severed, the plates remaining closed for engagement of the belts with the bag, and being opened either at some point in the downward descent of the bag or after the bag has been fully deposited in the carton.

It will be observed that the members 57 and 63 function as means to constrain the bag length at the lower end of the tubing T, containing product, at the front, back and at the sides to a shape such as to fit in the carton and that, on retraction of the member 63, the constraint is removed at the front and back for the descent of the filled, sealed and separated bag into the carton C at the carton loading station 14.

In view of the above, it will be seen that the several objects of the invention are achieved and other advantageous results attained.

As various changes could be made in the above constructions without departing from the scope of the invention, it is intended that all matter contained in the above description or shown in the accompanying drawings shall be interpreted as illustrative and not in a limiting sense.

What is claimed is:

1. The method forming, filling and sealing bags and depositing the bags in cartons, one bag per carton, each carton being one having front, back and side walls and closure flaps at the upper and lower ends of said walls and being of the type which may be supplied in a folded-flat collapsed condition and expanded to an open condition wherein it is substantially rectangular in transverse cross section, said method comprising:

forming flexible sheet packaging material into tubing;

intermittently feeding the tubing downwardly one bag length;

the tubing dwelling between successive feed cycles;

sealing the tubing transversely during the dwell following each downward feed of the tubing to form: a top seal for a bag to complete the bag and a bottom seal for the next bag to be formed; for each delivering product into the lower end of the tubing for each bag being formed prior to the formation of the top seal for the bag;

positioning an open carton at a carton loading station below and generally in line with the bag being formed for deposit of the bag in the carton;

the bag length at the lower end of the tubing, containing product, having a front, back and sides;

constraining said bag length at the lower end of the tubing, containing product, at the front, back and at the sides to a shape such as to fit in the said opened carton;

severing the tubing between said top and bottom seals to separate the filled, sealed and constrained bag from the tubing; and removing the constraint on the said filled, sealed and separated bag at the front and back for descent thereof into the carton.

2. The method of claim 1 wherein, on removal of the constraint, the bag drops into the carton.

3. The method of claim 2 wherein the carton is expanded in front-to-back direction for the descent of the completed filled, sealed and separated bag thereinto.

4. The method of claim 1 wherein the bag length at the lower end of the tubing, containing product, initially has a front-to-back dimension exceeding the front-to-back dimension of the carton and is compressed in front-to-back direction during the dwell to shape it to fit in the carton.

5. The method of claim 4 wherein the excess of the front-to-back dimension of the said bag length over the front-to-back dimension of the carton is limited.

6. The method of claim 4 wherein, on the compression of the bag length, its lateral expansion is limited to the carton width.

7. Apparatus for forming, filling and sealing bags and depositing the bags in cartons, one bag per carton, each carton being one having front, back and side walls and closure flaps at the upper and lower ends of said walls and being of the type which may be supplied in a folded-flat collapsed condition and expanded to an open condition wherein it is substantially rectangular in transverse cross section, said apparatus comprising:

means for forming flexible sheet packaging material into tubing;

means for intermittently feeding the tubing downwardly one bag length;

the tubing dwelling between successive feed cycles;

means for sealing the tubing transversely during the dwell following each downward feed of the tubing to form a top seal for a bag to complete the bag and a bottom seal for the next bag to be formed;

means for delivering a charge of product into the lower end of the tubing for each bag being formed prior to the formation of the top seal for the bag;

means for positioning an opened carton at a carton loading station below and generally in line with the bag being formed for deposit of the bag in the carton;

the bag length at the lower end of the tubing, containing product, having a front-to-back dimension exceeding the front-to-back dimension of the carton;

means for compressing the enlarged bag length in front-to-back direction during the dwell to shape it to fit in the carton; and means for severing the tubing between said to and bottom seals to separate the completed filled, sealed and compressed bag from the tubing for descent thereof into the carton;

wherein said carton positioning means comprises an endless conveyor having a series of carton holders spaced at equal intervals therealong, said conveyor carrying said holders through an endless generally horizontal path which extends underneath said compressing means and being intermittently operable to index said holders on interval one each operation in such manner that a holder moves into position at a carton delivery station for delivering a carton thereinto, and another holder, with an opened carton therein, moves into said position at said carton loading station below and generally in line with the bag being formed, and means for delivering an opened carton to each holder at the said delivery station; and means for swinging out the closure gaps at the upper ends of the side walls of an opened carton as it is conveyed by the conveyor to the carton loading station;

and wherein said flap-swinging means comprises an arm pivoted for swinging movement on an axis upstream from the carton loading station and above the carton top closure flaps, said arm being swingable in one direction from a retracted position into engagement with the trailing face of the leading side wall top closure flap for swinging that flap out, and then swingable back to retracted position, and being engageable on swinging back with the leading face of the trailing side wall top closure flap for swinging the latter out.

8. The method of forming, filling and sealing bags and depositing the bags in cartons, one bag per carton, each carton being one having front, back and side walls and closure flaps at the upper and lower ends of said walls and being of the type which may be supplied in a folded-flat collapsed condition and expanded to an open condition wherein it is substantially rectangular in transverse cross section, said method comprising:

forming flexible sheet packaging material into tubing;

intermittently feeding the tubing downwardly one bag length;

the tubing dwelling between successive feed cycles;

sealing the tubing transversely during the dwell following each downward feed of the tubing to form a top seal for a bag to complete the bag and a bottom seal for the next bag to be formed;

delivering product into the lower end of the tubing for each bag being formed prior to the formation of the top seal for the bag;

positioning an opened carton at a carton loading station below and generally in line with the bag being formed for deposit of the bag in the carton;

the bag length at the lower end of the tubing, containing product, having a front-to-back dimension exceeding the front-to-back dimension of the carton;

compressing the enlarged bag length in front-to-back direction ring the dwell to shape it to fit in the carton; and severing the tubing between said top and bottom seals to separate the completed filled, sealed and compressed bag from the tubing for descent thereof into the carton; and wherein the carton is expanded in front-to-back direction for the descent of the completed filled, sealed and compressed bag thereinto.

9. The method of claim 8 wherein the compression on the said bag length is released for descent of the completed filled, sealed and compressed bag into the carton by gravity.

10. The method of claim 9 wherein the gravity descent of the bag into the carton is a free fall.

11. The method of claim 8 wherein the excess of said front-to-back dimension of the said bag length over the front-to-back dimension of the carton is limited.

12. The method of claim 11 wherein, on the compression of the bag length, its lateral expansion is limited to the carton width.

13. The method of claim 12 wherein the compression on the said bag length is released for descent of the completed filled, sealed and compressed bag into the carton by gravity.

14. The method of claim 13 wherein the gravity descent of the bag into the carton is a free fall.

15. Apparatus for forming, filling and sealing bags and depositing the bags in cartons, one bag per carton, each carton being one having front, back and side walls and closure flaps at the upper and lower ends of said walls and being of the type which may be supplied in a folded-flat collapsed condition and expanded to an open condition wherein it is substantially rectangular in transverse cross section, said apparatus comprising:

means for forming flexible sheet packaging material into tubing;

means for intermittently feeding the tubing downwardly one bag length;

the tubing dwelling between successive feed cycles;

means for sealing the tubing transversely during the dwell following each downward feed of the tubing to form a top seal for a bag to complete the bag and a bottom seal for the next bag to be formed;

means for delivering a charge of product into the lower end of the tubing for each bag being formed prior to the formation of the top seal for the bag;

means for positioning an opened carton at a carton loading station below and generally in line with the bag being formed for deposit of the bag in the carton;

the bag length at the lower end of the tubing, containing product, having a front, back and sides;

means for constraining said bag length at the lower end of the tubing, containing product, at the front, back and at the sides to a shape such as to fit in the said opened carton;

means for severing the tubing between said top and bottom seals to separate the filled, sealed and constrained bag from the tubing; and means for removing the constraint on the said filled, sealed and separated bag at the front and back for descent thereof into the carton.

16. Apparatus as set forth in claim 15 wherein the means for removing the constraint on the bag releases it to drop into the carton.

17. Apparatus as set forth in claim 16 having means for expanding the carton in front-to-back direction for the descent of the completed filled, sealed and separated bag thereinto.

18. Apparatus as set forth in claim 15 wherein the bag length at the lower end of the tubing, containing product, initially has a front-to-back dimension exceeding the front-to-back dimension of the carton, and the constraining means comprises means for compressing said bag length in front-to-back direction during the dwell to shape it to fit in the carton.

19. Apparatus as set forth in claim 15 wherein said sealing means comprises a pair of sealing members movable relatively to one another from an open position to a closed position engaging the tubing for forming said top and bottom seals, the means for feeding the tubing being operable when the sealing members are open for feeding the tubing downwardly said bag length, the severing means being associated with the sealing members, wherein the constraining means comprises a front member and a back member below the sealing members, at least one of which has sides spaced a distance corresponding to the carton width, said front and back members being movable relatively to one another in front-to-back direction from an open position wherein they are spaced a distance in excess of the front-to-back dimension of the carton and a closed position wherein they are spaced a lesser distance for the constraint of the said bag length.

20. Apparatus as set forth in claim 19 wherein said front and back members have means associated therewith for expanding the carton when said front and back members move relatively to one another to the open position.

21. Apparatus for forming, filling and sealing bags and depositing the bags in cartons, one bag per carton, each carton being one having front, back and side walls and closure flaps at the upper and lower ends of said walls and being of the type which may be supplied in a folded-flat collapsed condition and expanded to an open condition wherein it is substantially rectangular in transverse cross section, said apparatus comprising:

means for forming flexible sheet packaging material into tubing;

means intermittently feeding the tubing downwardly one bag length;

the tubing dwelling between successive feed cycles;

means for sealing the tubing transversely during the dwell following each downward feed of the tubing to form a top seal for a bag to complete the bag and a bottom seal for the next bag to be formed;

means for delivering a charge of product into the lower end of the tubing for each bag being formed prior to the formation of the top seal for the bag;

means for positioning an opened carton at a carton loading station below and generally in line with the bag being formed for deposit of the bag in the carton;

the bag length at the lower end of the tubing, containing product, having a front-to-back dimension exceeding the front-to-back dimension of the carton;

means for compressing the enlarged bag length in front-to-back direction during the dwell to shape it to fit in the carton; and means for severing the tubing between said top and bottom seals to separate the completed filled, sealed and compressed bag from the tubing for descent thereof into the carton;

said sealing means comprising a pair of sealing members movable relatively to one another from an open position to a closed position engaging the tubing for forming said top and bottom seals, the means for feeding the tubing being operable when the sealing members are open for feeding the tubing downwardly said bag length, the severing means being associated with the sealing members, the compressing means comprising front and back compression members below the sealing members movable relatively to one another in front-to-back direction from an open position wherein they are spaced a distance in excess of the front-to-back dimension of the carton and a closed position wherein they are spaced a distance slightly less than the front-to-back dimension of the carton for the compression of the bag length;

and wherein the compression members have downward extensions engageable with the inside of the flaps at the upper ends of the front and back walls of the carton for expanding the carton when said compression members move relatively to one another to the open position.

22. Apparatus for forming, filling and sealing bags and depositing the bags in cartons, one bag per carton, each carton being one having front, back and side walls and closure flaps at the upper and lower ends of said walls and being of the type which may be supplied in a folded-flat collapsed condition and expanded to an open condition wherein it is substantially rectangular in transverse cross section, said apparatus comprising:

means for forming flexible sheet packaging material into tubing;

means for intermittently feeding the tubing downwardly one bag length;

the tubing dwelling between successive feed cycles;

means for sealing the tubing transversely during the dwell following each downward feed of the tubing to form a top seal for a bag to complete the bag and a bottom seal for the next bag to be formed;

means for delivering a charge of product into the lower end of the tubing for each bag being formed prior to the formation of the top seal for the bag;

means for positioning an opened carton at a carton loading station below and generally in line with the bag being formed for deposit of the bag in the carton;

the bag length at the lower end of the tubing, containing product, having a front-to-back dimension exceeding the front-to-back dimension of the carton;

means for compressing the enlarged bag length in front-to-back direction during the dwell to shape it to fit in the carton; and means for severing the tubing between said top and bottom seals to separate the completed filled, sealed and compressed bag from the tubing for descent thereof into the carton;

and said apparatus having means associated with said compression means for expanding the carton in front-to-back direction for the descent of the filler, sealed and compressed bag thereinto.

23. Apparatus as set forth in claim 22 wherein the means for compressing the enlarged bag length is operable to release the compression on the said bag length for descent of the completed filled, sealed and compressed bag into the carton by gravity.

24. Apparatus as set forth in claim 23 wherein the means for compressing the bag is retractable to free the bag for free fall into the carton.

25. Apparatus as set forth in claim 22 wherein the means for compressing the enlarged bag length acts to limit the excess of the front-to-back dimension of the bag length over the front-to-back dimension of the carton.

26. Apparatus as set forth in claim 25 having means associated with said compression means for limiting lateral expansion of the bag length to the carton width on operation of the compression mean to compress the bag length.

27. Apparatus as set forth in claim 26 wherein the means for compressing the enlarged bag length is operable to release the compression on the said bag length for descent of the completed filled, sealed and compressed bag into the carton by gravity.

28. Apparatus as set forth in claim 27 wherein the means for compressing the bag is retractable to free the bag for free fall into the carton.

29. Apparatus for supplying opened cartons to a carton loading station for the loading of the cartons comprising an endless conveyor having a series of carton holders spaced at equal intervals therealong, said conveyor being intermittently operable to index said holders one interval on each operation in such manner that a holder moves into position at a carton delivery station for delivering a carton thereinto, each holder having side walls spaced a distance corresponding to the width of a carton extending outwardly from the conveyor, each holder being open at the outside between said side walls for insertion of a carton thereinto from the outside and removal of a carton with a bag therein toward the outside, means for delivering a carton to each holder at said delivery station comprising means for holding a supply stack of folded-flat cartons with the stack generally horizontal, extending toward the conveyor generally in alignment with the holder at the loading station, and with the end of the stack toward the conveyor adjacent the open outside of that holder, each folded-flat carton in the stack having its front, back and side walls upright, means for effecting swinging of the side walls and front wall of the end carton at that end of the stack constituting its forward end away from the back wall of said end carton while holding the back wall against movement to open said end carton, means separate from said opening means for drawing the opened carton into the holder dwelling at the delivery station, and means for advancing the stack upon delivery of the opened carton to a holder to present the next folded-flat carton for being opened by said opening means.

30. Apparatus as set forth in claim 29 having means for swinging out the closure flaps at the upper ends of the side walls of an opened carton as it is conveyed by the conveyor to the carton loading station.

31. Apparatus as set forth in claim 30 wherein said flap-swinging means comprises an arm pivoted for swinging movement in an axis upstream from the carton loading station and above the carton top closure flaps, said arm being swingable in one direction from a retracted position into engagement with the trailing face of the leading side wall top closure flap for swinging that flap out, and then swingable back to retracted position, and being engageable on swinging back with the leading face of the trailing side wall top closure flap for swinging the latter out.

32. Apparatus for forming, filling and sealing bags and depositing the bags in cartons, one bag per carton, each carton being one having front, back and side walls and closure flaps at the upper and lower ends of said walls and being of the type which may be supplied in a folded-flat collapsed condition and expanded to an open condition wherein it is substantially rectangular in transverse cross section, said apparatus comprising:

means for forming flexible sheet packaging material into tubing;

means for intermittently feeding the tubing downwardly one bag length;

the tubing dwelling between successive feed cycles;

means for sealing the tubing transversely during the dwell following each downward feed of the tubing to form a top seal for a bag to complete the bag and a bottom seal for the next bag to be formed;

means for delivering a charge of product into the lower end of the tubing for each bag being formed prior to the formation of the top seal for the bag;

means for positioning an opened carton at a carton loading station below and generally in line with the bag being formed for deposit of the bag in the carton;

the bag length at the lower end of the tubing, containing product, having a front-to-back dimension exceeding the front-to-back dimension of the carton;

means for compressing the enlarged bag length in front-to-back direction during the dwell to shape it to fit in the carton; and means for severing the tubing between said top and bottom seals to separate the completed filled, sealed and compressed bag from the tubing for descent thereof into the carton;

and wherein the said carton positioning means comprises an endless conveyor having a series of carton holders spaced at equal intervals therealong, said conveyor carrying said holders through an endless generally horizontal path which extends underneath said compressing means and being intermittently operable to index said holders one interval on each operation in such manner that a holder moves into position at a carton delivery station for delivering a carton thereinto, and another holder, with an opened carton therein, moves into said position at said carton loading station below and generally in line with the bag being formed, and means for delivering an opened carton to each holder at the said delivery station.

33. Apparatus as set forth in claim 32 wherein each holder has side walls spaced a distance corresponding to the width of a carton extending outwardly from the conveyor, each holder being open at its outside for insertion of an opened carton thereinto from the outside and removal of a carton with a bag therein toward the outside, said means for delivering a carton to each holder at said delivery station comprising means for holding a supply stack of folded-flat cartons on the outside of the conveyor with the stack generally horizontal, extending toward the conveyor generally in alignment with the holder at the delivery station, and with the end of the stack toward the conveyor adjacent the open outside of that holder, each folded-flat carton in the stack having its front, back and side walls upright, means for opening the carton at the end of the stack toward the conveyor, means for drawing the opened carton into the holder at the delivery station, and means for advancing the stack upon loading of the opened carton in a holder to present the next folded-flat carton for being opened by said opening means.

34. Apparatus as set forth in claim 33 wherein the folded-flat cartons are disposed in the horizontal stack with one side wall of each carton facing toward the conveyor and at one side of the stack and the other side wall away from the conveyor and at the other side of the stack, said means for opening the endmost carton at the forward end of the stack comprising vacuum gripper means movable from retracted position at said one side of the stack to a position in gripping engagement with the forward face of said one side wall of said endmost carton and back to retracted position to swing that side wall forward to its open position, carrying said one of the front and back walls and the other side wall of the carton to open position, the vacuum grip of the gripper means on said one side wall being releasable when that side wall is swung to its open position for the drawing of the opened carton into the carton holder at the loading station.

35. Apparatus as set forth in claim 34 wherein the means for drawing the opened carton into the holder comprises vacuum grip means movable into engagement with the said one of the front and back walls from the back of the holder at the carton delivery station and then back to retracted position to draw the opened carton into the holder.

36. Apparatus as set forth in claim 35 having retractable stops engageable with top and bottom closure flaps of the other of the front and back walls via a space between the top closure flaps of the said one of the front and back walls and the said one side wall, and a notch in the bottom closure flap of said one of the front and back walls, said stops holding back the said other of the front and back walls for the opening of the endmost carton and being retractable to release the opened carton for being drawn into the holder.

37. Apparatus as set forth in claim 36 having means engageable by the endmost carton at the side opposite the opening means for holding it in its folded-flat condition, said means being movable to release the endmost carton at said side opposite the opening means to permit the carton to be opened.

38. Apparatus as set forth in claim 37 having means extending in front of the endmost carton engageable by the said one of the front and back walls to limit its movement toward the conveyor, said limiting means being retractable for the drawing of the carton into the holder.

39. Apparatus as set forth in claim 38 having means permitting the opened carton to be drawn into the holder and then retaining it therein as the holder moves away from the carton delivery station.

40. Apparatus for forming, filling sealing bags and depositing the bags in cartons, one bag per carton, each carton being one having front, back and side walls and closure flaps at the upper and lower ends of said walls and being of the type which may be supplied in a folded-flat collapsed condition and expanded to an open condition wherein it is substantially rectangular in transverse cross section, said apparatus comprising:

means for forming flexible sheet packaging material into tubing;

means for intermittently feeding the tubing downwardly one bag length;

the tubing dwelling between successive feed cycles;

means for sealing the tubing transversely during the dwell following each downward feed of the tubing to form a top seal for a bag to complete the bag and a bottom seal for the next bag to be formed;

means for delivering a charge of product into the lower end of the tubing for each bag being formed prior to the formation of the top seal for the bag;

means for positioning an opened carton at a carton loading station below and generally in line with the bag being formed for deposit of the bag in the carton;

the bag length at the lower end of the tubing, containing product, having a front-to-back dimension exceeding the front-to-back dimension of the carton;

means for compressing the enlarged bag length in front-to-back direction during the dwell to shape it to fit in the carton; and means for severing the tubing between said top and bottom seals to separate the completed filled, sealed and compressed bag from the tubing for descent thereof into the carton;

said means for compressing the enlarged bag length acting to limit the excess of the front-to-back dimension of the bag length over the front-to-back dimension of the carton;

and said apparatus having means associated with said compression means for limiting lateral expansion of the enlarged bag length to the carton width on operation of the compression mean to compress the bag length.

41. Apparatus as set forth in claim 40 wherein the means for compressing the enlarged bag length is operable to release the compression on the said bag length for descent of the completed filled, sealed and compressed bag into the carton by gravity.

42. Apparatus as set forth in claim 41 wherein the means for compressing the bag is retractable to free the bag for free fall into the carton.

43. Apparatus for supplying opened cartons to a carton loading station for the loading of the cartons comprising an endless conveyor having a series of carton holders spaced at equal intervals therealong, said conveyor being intermittently operable to index said holders on interval on each operation in such manner that a holder moves into position at a carton delivery station for delivering a carton thereinto, each holder having side walls spaced a distance corresponding to the width of a carton extending outwardly from the conveyor, each holder being open at the outside between said side walls for insertion of a carton thereinto from the outside and removal of a carton with a bag therein toward the outside, means for delivering a carton to each holder at said delivery station comprising means for holding a supply stack of folded-flat cartons with the stack generally horizontal, extending toward the conveyor generally in alignment with the holder at the loading station, and with the end of the stack toward the conveyor adjacent the open outside of that holder, each folded-flat carton in the stack having its front, back and side walls upright, means for opening the end carton at that end of the stack constituting its forward end, means for drawing the opened carton into the holder dwelling at the delivery station, and means for advancing the stack upon delivery of the opened carton to a holder to present the next folded-flat carton for being opened by said opening means; wherein the folded-flat cartons are disposed in the horizontal stack with one side wall of each carton facing toward the conveyor and at one side of the stack and the other side wall away from the conveyor and at the other side of the stack, said means for opening the endmost carton at the forward end of the stack comprising vacuum gripper means movable from retracted position at said one side of the stack to a position in gripping engagement with the forward face of said one side wall of said endmost carton and back to retracted position to swing that side wall forward to its open position, carrying said one of the front and back walls and the other side wall of the carton to open position, the vacuum grip of the gripper means on said one side wall being releasable when that side wall is swung to its open position for the drawing of the opened carton into the carton holder at the loading station.

44. Apparatus as set forth in claim 43 wherein the means for drawing the opened carton into the holder comprises vacuum grip means movable into engagement with the said one of the front and back walls from the back of the holder at the carton delivery station and then back to retracted position to draw the opened carton into the holder.

45. Apparatus as set forth in claim 44 having retractable stops engageable with top and bottom closure flaps of the other of the front and back walls via a space between the top closure flaps of the said one of the front and back walls and the said one side wall, and a notch in the bottom closure flap of said one of the front and back walls, said stops holding back the said other of the front and back walls for the opening of the endmost carton and being retractable to release the opened carton for being drawn into the holder.

46. Apparatus as set forth in claim 45 having means engageable by the endmost carton at the side opposite the opening means for holding it in its folded-flat condition, said means being movable to release the endmost carton at said side opposite the opening means to permit the carton to be opened.

47. Apparatus as set forth in claim 46 having means extending in front of the endmost carton engageable by the said one of the front and back walls to limit its movement toward the conveyor, said limiting means being retractable for the drawing of the carton into the holder.

48. Apparatus as set forth in claim 47 having means permitting the opened carton to be drawn into the holder and then retaining it therein as the holder moves away from the carton delivery station.

49. Apparatus forming, filling and sealing bags and depositing the bags in cartons, one bag per carton, each carton being one having front, back and side walls and closure flaps at the upper and lower ends of said walls and being of the type which may be supplied in a folded-flat collapsed condition and expanded to an open condition wherein it is substantially rectangular in transverse cross section, said apparatus comprising:

means for forming flexible sheet packaging material into tubing;

means for intermittently feeding the tubing downwardly one bag length;

the tubing dwelling between successive feed cycles;

means for sealing the tubing transversely during the dwell following each downward feed of the tubing to form a top seal for bag to complete the bag and a bottom seal for the next bag to be formed;

means for delivering a charge of product into the lower end of the tubing for each bag being formed prior to the formation of the top seal for the bag;

means for positioning an opened carton at a carton loading station below and generally in line with the bag being formed for deposit of the bag in the carton;

the bag length at the lower end of the tubing, containing product, having a front-to-back dimension exceeding the front-to-back dimension of the carton;

means for compressing the enlarged bag length in front-to-back direction during the dwell to shape it to fit in the carton; and means for severing the tubing between said top and bottom seals to separate the completed filled, sealed and compressed bag from the tubing for descent thereof into the carton;

said sealing means comprising a pair of sealing members movable relatively to one another from an open position to a closed position engaging the tubing for forming said top and bottom seals, the means for feeding the tubing being operable when the sealing members are open for feeding the tubing downwardly said bag length, the severing means being associated with the sealing members, the compressing means comprising front an back compression members below the sealing members movable relatively to one another in front-to-back direction from an open position wherein they are spaced a distance in excess of the front-to-back dimension of the carton and a closed position wherein they are spaced a distance slightly less than the front-to-back dimension of the carton for the compression of the bag length;

and wherein said compression members have side members associated therewith for limiting the lateral expansion of the bag length compressed thereby to the carton width so that, upon the compression of the bag length, it is shaped to fit in the carton.

* * * * *